US009788586B2

(12) United States Patent
Kendis

(10) Patent No.: US 9,788,586 B2
(45) Date of Patent: Oct. 17, 2017

(54) APPARATUS FOR MOUNTING AN ELECTRONIC DEVICE ON A BRIM OF A HEADPIECE AND METHOD OF MANUFACTURING THE APPARATUS

(71) Applicant: Randall Jay Kendis, Coronado, CA (US)

(72) Inventor: Randall Jay Kendis, Coronado, CA (US)

( * ) Notice: Subject to any disclaimer, the term of this patent is extended or adjusted under 35 U.S.C. 154(b) by 350 days.

(21) Appl. No.: 14/100,018

(22) Filed: Dec. 9, 2013

(65) Prior Publication Data

US 2015/0157078 A1 Jun. 11, 2015

(51) Int. Cl.
*A42B 1/24* (2006.01)
*A45F 5/02* (2006.01)

(52) U.S. Cl.
CPC ..... *A42B 1/24* (2013.01); *A45F 5/02* (2013.01); *A45F 2005/025* (2013.01); *Y10T 24/1394* (2015.01); *Y10T 29/49002* (2015.01)

(58) Field of Classification Search
CPC ..... G03B 17/56; G03B 369/419; G03B 396/544; G03B 348/82; G03B 382/109; G02B 27/01; G02B 345/07; G02B 349/11; G02B 1/163
See application file for complete search history.

(56) References Cited

U.S. PATENT DOCUMENTS 3,069,539 A 12/1959 Kidd
5,199,780 A 4/1993 Ekman
D401,005 S 11/1998 Ludbrook et al.
6,250,769 B1 6/2001 Kirk
D464,750 S 10/2002 Cooper
6,616,294 B1 9/2003 Henry
6,874,167 B1 * 4/2005 Leszczynski ..... G09F 21/02 2/209.13
7,461,764 B2 12/2008 Thompson
7,508,932 B1 3/2009 Bergh
7,703,938 B1 4/2010 Brown, Jr.
8,019,110 B1 9/2011 Johnson
2004/0180691 A1 9/2004 Cascone
2004/0204207 A1 10/2004 Parker
2010/0254123 A1 10/2010 Brown
2010/0287685 A1 11/2010 Peterson
2010/0311390 A9 12/2010 Black
2011/0248060 A1 * 10/2011 Luk ..... B60R 11/02 224/567
2012/0317706 A1 * 12/2012 Lebel ..... F41H 1/08 2/422

(Continued)

OTHER PUBLICATIONS

Hatcams, LLC, "Hatcam Products" 2011 Website: http://www.hatcams.com/hatcam_products.html, Wallingford, Connecticut U.S.A. (Accessed Sep. 20, 2013).

*Primary Examiner* — Mekonnen Dagnew
(74) *Attorney, Agent, or Firm* — David B. Waller

(57) ABSTRACT

Attachable and detachable apparatus for mounting an electronic device on a brim of a headpiece and method of manufacturing the apparatus. A mount or cradle is adapted to receive and retain the electronic device. The mount or cradle is connected to a clip, the clip being adapted to engage the brim, The electronic device is mounted on the brim while the clip is coupled to the mount or cradle and engages the brim, and while the mount or cradle retains the electronic device.

5 Claims, 35 Drawing Sheets

(56) References Cited

U.S. PATENT DOCUMENTS

| | | | | |
|---|---|---|---|---|
| 2013/0201299 | A1* | 8/2013 | Waters | A42B 1/244 348/49 |
| 2015/0016813 | A1* | 1/2015 | Swaggart | G03B 17/566 396/423 |

* cited by examiner

APPARATUS FOR MOUNTING AN ELECTRONIC DEVICE ON A BRIM OF A HEADPIECE AND METHOD OF MANUFACTURING THE APPARATUS

CROSS REFERENCE TO RELATED APPLICATIONS

This application claims benefit of Provisional Patent Application Ser. No. 61/845,327 filed Jul. 11, 2013 in the name of Randall J. Kendis and titled "SMARTPHONE HAT MOUNT", and also claims benefit of Provisional Patent Application Ser. No. 61/862,592 filed Aug. 6, 2013 in the name of Randall J. Kendis and titled "REMOVABLE UNIVERSAL CAMERA MOUNT FOR HATS AND VISORS", the disclosures of which are hereby incorporated by reference in their entirety to the extent such disclosures are consistent with the disclosure herein.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not applicable.

FIELD OF THE INVENTION

This invention generally relates to hat or cap attachments and more particularly relates to apparatus attachable to and detachable from a brim of a headpiece for carrying an article on the brim of the headpiece, and methods of manufacturing the apparatus.

BACKGROUND OF THE INVENTION

Use of electronic devices, such as "smartphones" and "camcorders", with video and audio electronic transmission capabilities is becoming increasingly popular with consumers. For example, it has been estimated that, by May, 2013 about 141 million people in the United States owned smartphones. This represents roughly 59% of the total mobile telephone market in the United States and this percentage continues to grow. In addition, it has been estimated that there are 1.2 billion smartphone owners globally. With regard to camcorders, in 2012 the proportion of U.S. households owning a camcorder was estimated at 57%. Hence, camcorders continue to occupy a significant share of the marketplace for video and audio recording devices. Therefore, it is not surprising that various devices and software applications are now commercially available for use with smartphones and camcorders.

A "smartphone" is commonly defined as a cellular telephone that provides digital image and voice services and that has one or more software applications installed in the cellular telephone. The installed software applications typically provide Internet access, text messaging, electronic mail (i.e., e-mail), Web browsing, still and video image capture, electronic transmission of still and video images, still and video image playback, digital audio player capability (e.g., in the form of an MP3 player software application also commonly referred to as MPEG-1 or MPEG-2 Audio Layer III player capability), and other functions. A "camcorder" is commonly defined as a small portable combined camera and video recording device used to capture both video and audio.

In addition, it is known that smartphones and camcorders are often used to capture video and audio at various venues. These venues include, but are not limited to, sporting events, music concerts, family gatherings, political gatherings, automobile accident scenes, tourist vacation locations, and other venues. The capability of smartphones and camcorders to conveniently capture images and audio has resulted in the ubiquitous presence of smartphones and camcorders that are used by sports fans, concert goers, family members, journalists, accident insurance adjustors, tourists and others.

However, a consideration is smartphones and camcorders require using at least one hand to hold and point the smartphone or camcorder at the object and/or activity being recorded. Requiring at least one hand to hold and point the smartphone or camcorder can be problematic when the smartphone or camcorder is used to record objects and events. For example, holding the smartphone or camcorder to record images while walking can compromise safety of the user of the smartphone or camcorder because the smartphone or camcorder will obstruct the user's view. Obstructing the user's view in this manner increases the likelihood that the user will trip, fall and be injured. In addition, fatigue caused by the user holding his arms out for extended periods of time can result in unsteady video capture and degraded quality of the video capture. Further, a user cannot safely use a smartphone or camcorder to record images while riding a bicycle, motor cycle or while driving an automobile. In addition, a person having limited hand and wrist movement, such as an arthritic or partially paralyzed individual, will have difficulty holding and manipulating the smartphone or camcorder to record images and sounds of objects and events. Moreover, directing one's attention to holding and manipulating the smartphone or camcorder can detract from one's enjoyment of the object or event being recorded.

Another consideration is some garments lack pockets to stow a smartphone or camcorder when the smartphone or camcorder is not being used. This is typically the case when the user is wearing swimwear. This is also the case with regard to some women's apparel, such as haute couture fashion apparel.

Therefore, it is desirable that video and audio devices, such as smartphones and camcorders, be operable by the user in a manner that avoids the considerations mentioned hereinabove.

Attempts have been made to address the considerations mentioned hereinabove. For example, U.S. Pat. No. 6,250,769 B1 titled "Visor Light Cap" issued Jun. 26, 2001 in the name of Clair F. Kirk relates to caps and similar head covers ("headgear") which are worn by persons who work in or are otherwise engaged in activities in dark places. According to the Kirk '769 patent, headgear, such as a cap for use in dark and very confined spaces, has a light source attached to its visor in a manner that the light beam is parallel to the central axis of the visor and to the plane of vision of the wearer. Affixed to the top of the visor is a first fastener, which is preferably Velcro® and has an upper surface for detachably connecting to a second fastener. The second fastener, which also may be Velcro®, has a lower surface for detachably connecting to the first fastener. The second fastener also has an upper surface attached to a surface of the light source.

However, the first fastener of the cap disclosed by the Kirk '769 patent does not appear removable from the visor because the first fastener appears permanently affixed to the top of the visor. Therefore, it appears the first fastener remains a permanent, integral part of the cap even when the light source is detached and disconnected from the first fastener. Consequently, it appears a conventional cap must be permanently modified to accommodate the first fastener.

Another attempt to address the considerations mentioned hereinabove is disclosed in U.S. Pat. No. 6,616,294 B1 titled "Hard Hat Mounted Flashlight Holder" issued Sep. 9, 2003 in the name of David Vincent Henry. The Henry '294 patent relates to flashlights and holders for holding flashlights. According to this patent, a flashlight holder is provided for use with a conventional hard hat without modification of the hard hat. The flashlight holder is designed such that a flashlight can be operated with one hand when retained in the flashlight holder. The flashlight holder is adapted to releasably receive a flashlight of the type defining a faceted barrel and a head which is rotatable relative to the barrel for operation of the flashlight. According to this patent, the hard hat of a conventional configuration defines a slotted receptacle on either side of the hard hat for receiving various conventional attachments, such as a face guard or other safety device. A tab extends from the base of the flashlight holder and is configured to be releasably engaged within the slotted receptacle. A locking projection extends from the tab for engaging a lower edge of the hard hat in order to lock the flashlight holder to the hard hat.

However, the Henry '294 patent appears specifically directed to a flashlight holder for use with a conventional hard hat. In this regard, the slotted receptacle that is defined by the conventional hard hat and that is normally used for safety-related purposes (e.g., receiving a face guard or other safety device) is instead used to receive the flashlight holder. Use of the slotted receptacle to receive the flashlight holder necessarily makes the slotted receptacle unavailable for its normal safety-related use, such as being used for receiving a face guard or other safety device. Such a substitution might compromise safety of the wearer. Also, there does not appear to be disclosure of devices other than flashlights for use with the conventional hard hat mentioned in the Henry '294 patent. For example, there does not appear to be a disclosure of an electronic image capture device for use with the hard hat. Moreover, types of headgear in addition to hard hats do not appear to be disclosed.

Yet another attempt to address the considerations mentioned hereinabove is disclosed in U.S. Pat. No. 8,019,110 B1 titled "Removable Hat Attaching Device For Housing An Electronic Device" issued Sep. 13, 2011 in the name of Ben Edward Johnson. The Johnson '110 patent relates to a removable hat attaching device for housing an electronic device that is secured in a "billed" style hat. According to this patent, the device includes a front portion and two arm portions, with the electronic device preferably secured to the front portion and a speaker member disposed near the end of each arm portion. This patent states no modifications, alterations or adjustments to the hat (i.e., baseball cap) are required for securing the device from one hat to another.

The Johnson '110 patent also discloses that the device preferably houses an electronic device, such as, but not limited to, one or more of the following: a radio, MP3 player, cell phone, IPod, satellite radio, GPS navigation, clock, thermometer, calculator, PDA, television, etc. which is preferably mounted to the device such that it is disposed underneath the bill area of the hat. According to this patent, the electronic device is mounted underneath the bill area of the hat for easy access by the wearer without taking off his or her hat. In the case of a cell phone, the user could answer phone calls for the cell phone through voice animation and also continue with whatever he or she was doing. In one embodiment, a solar panel can be mounted to the device such that it is disposed on the top surface of the bill area to receive solar energy used to power the electronic device. Alternatively, the top surface of the area of the device could be used as a battery compartment. As a further alternative, the electronic device is powered internally or at some other location.

However, the Johnson '110 patent discloses that the electronic device is disposed underneath the bill area of the hat for accessibility, rather than being disposed on top of the bill area of the hat. Also, as best can be understood, the cell phone mentioned in the Johnson '110 patent appears to be used merely for answering phone calls for the cell phone. The Johnson '110 patent does not expressly mention other uses for the cell phone, such as image capture. In addition, it appears the structure of the Johnson device is preferably and primarily used merely to house the electronic device and apparently for no other purpose, except for answering calls through voice animation. Moreover, types of headgear in addition to baseball caps do not appear to be disclosed.

Still another attempt to address the considerations mentioned hereinabove is disclosed in U.S. Patent Application Publication No. US 2010/0287685 A1 titled "Universal Camera Mount For Baseball Cap" published Nov. 18, 2010 in the name of Randy Peterson. The Peterson patent application publication relates to a camera mounting system for mounting a camera or camcorder on the brim of a hat. In some embodiments, the cap includes a washer, nut and bolt or screw for mounting the camera or camcorder on the brim of the hat. In some other embodiments, a bolt is attached to the brim by means of a custom assembly. In other preferred embodiments, the cap includes a tripod head attached to the brim with a screw or bolt for attaching a camera or camcorder. The head could be a ball and socket type head, a pan-tilt type head, or the like. Although any small camera, camcorder or the like could be attached to the bolt or screw, preferably a digital camcorder which records video to solid state memory cards is used with the cap.

However, the Peterson published patent application appears to disclose that the mounting bolt is permanently attached to the brim of the hat, rather than being removable and reattached to another hat. Thus, it appears that a conventional hat must be permanently modified to accept the mounting bolt.

Although the approaches recited hereinabove disclose various configurations with respect to apparatus attachable to a headpiece for carrying an article on the headpiece, the approaches recited hereinabove do not appear to disclose the inventions described and claimed hereinbelow.

BRIEF SUMMARY OF THE INVENTION

The present invention addresses the shortcomings of the prior art approaches mentioned hereinabove by providing an apparatus for mounting an electronic device on a brim of a headpiece and method of manufacturing the apparatus.

The headpiece can be a cap (e.g., a baseball cap), fedora, visor (i.e., a head band having a bill or peak outwardly projecting from the front of the head band), hard hat with a brim, floppy hat (i.e., a hat having a wide brim offering maximum protection from the sun), or other type of brimmed head covering. The headpiece can be made of cloth, felt, metal, polymer plastic, straw or other suitable material.

The apparatus of the present invention allows a video and audio electronic device, such as a smartphone or camcorder, to record or transmit, hands-free, images and sounds associated with objects and events in a multiplicity of venues.

Transmission of live video and audio capture may be accomplished by Wi-Fi® (i.e., Electrical and Electronics Engineers IEEE 802.11X), Bluetooth® Wireless Technology, and Internet or mobile networks. The "Wi-Fi®" word mark is a registered trademark owned by the Wi-Fi Alliance located in Austin, Tex. U.S.A. The Bluetooth® word mark is a registered trademark owned by Bluetooth SIG, Incorporated located in Kirkland, Wash. U.S.A. By way of example only, and not by way of limitation, the objects, events and venues can include music concerts, family gatherings, political gatherings, automobile accident scenes, tourist vacation locations, and other objects, events and venues. In the case of a smartphone or camcorder electronic device, the apparatus allows a user thereof to record or transmit with the smartphone or camcorder in a safer manner and with reduced fatigue. In this regard, the apparatus allows a user thereof to safely use the smartphone or camcorder while walking because the smartphone or camcorder will not obstruct the user's view. In addition, use of the apparatus substantially avoids arm fatigue because the apparatus allows hands-free recording of video and audio. Use of the apparatus can also improve unsteady video capture and quality of video capture because arm fatigue is reduced. Further, when utilizing the apparatus, a user can safely use a smartphone or camcorder to record or transmit images while riding a bicycle, while riding a motor cycle, while driving an automobile, or while operating other conveyances. In addition, a person having limited hand and wrist movement, such as an arthritic or partially paralyzed individual, will no longer need to hold and manipulate the smartphone or camcorder to record images and sounds at events and venues. Also, the apparatus allows one to enjoy the object or event being recorded, rather than directing one's attention to holding and manipulating the smartphone or camcorder. Moreover, the user can easily stow the apparatus even while wearing garments lacking pockets, such as in the case of swimwear and haute couture fashion apparel. In this case, the apparatus is stowed on the brim of the headpiece worn by the user when the apparatus is not being used.

In an exemplary embodiment, the apparatus includes a cradle defining a groove or slot in the top surface thereof for receiving an electronic device, such as a smartphone or camcorder. The smartphone or camcorder is used to record images and/or sounds of an object or an event. The slot can have a generally step-shape transverse profile for receiving electronic devices of various thicknesses. Alternatively, the slot can have a generally V-shape transverse profile for receiving electronic devices of various thicknesses. The electronic device is oriented in the slot, such that an optical lens and microphone belonging to the electronic device is aligned generally parallel to a front surface of the cradle and points toward the object and/or event to be recorded.

In this exemplary embodiment, an elongate retaining band releasably secures the electronic device in the slot defined by the cradle. The retaining band can be elastic to accommodate various widths and thicknesses of electronic devices. Alternatively, the retaining band can be inelastic and sized to custom fit a particular width and thickness of electronic device. In either case, the retaining band has an end portion thereof affixed to a retaining point located on an underside surface of the cradle and extends from the retaining point in a manner that spans the electronic device while the electronic device is received in the slot. The other end portion of the retaining band is releasably secured to a post or brad that outwardly projects from the front surface of the cradle. In this manner, the electronic device is releasably secured in the slot defined by the cradle. Alternatively, the retaining band can have a male (or female) "VELCRO® brand" fastener end portion. The VELCRO® brand fastener end portion is engageable with a female (or male) VELCRO® brand fastener that is used rather than the post.

Also, in this exemplary embodiment, one or more U-shaped, outwardly projecting clips are coupled to the underside surface of the cradle for releasably securing the cradle to the bill, peak or brim of the headpiece. In this exemplary configuration of the clips, the clips are fixed in their outwardly-projecting orientation.

In another exemplary configuration of the clips, the clips are pivotally, outwardly extendable from the underside surface of the cradle to engage the brim of the headpiece. Also, the clips are pivotally, inwardly retractable back to the underside surface of the cradle after the clips are caused to disengage the brim of the headpiece when the apparatus is removed from the brim of the headpiece. Pivoting the clips inwardly to retract the clips back to the underside surface of the cradle after being caused to disengage the brim of the headpiece reduces the outside spatial envelope of the apparatus. Reducing the outside spatial envelope of the apparatus allows the apparatus to be conveniently stored in pocket or purse.

In another exemplary configuration of the clips, each clip comprises a movable locking arm for releasably locking the clips to the brim of the headpiece while the clips engage the brim of the headpiece.

In a further exemplary configuration of the clips, each clip has a C-shaped first end portion for retaining the electronic device and a U-shaped second end portion for engaging the brim of the headpiece. In addition, two or more spaced-apart brackets are coupled to the C-shaped first end portion for receiving the electronic device therebetween. In this manner, the electronic device is releasably gripped or captured between the brackets in order to allow mounting of the electronic device on the brim of the headpiece while the U-shaped second end portion of the clip engages the brim of the headpiece.

In an additional exemplary configuration of the clips, each clip comprises a leaf spring having a ridge thereon that releasably engages the brim of the headpiece for securely, but removably, connecting the apparatus to the headpiece.

In an additional exemplary embodiment of the apparatus, a support strap that may be elastic or inelastic is connected to a side edge of the cradle. The support strap can be extended from the side edge of the cradle, circumferentially around the outer surface of the headpiece, and releasably secured to an outwardly projecting anchor bolt or peg located at an opposing side edge of the cradle. The support strap provides added support for securing the apparatus to the headpiece while the headpiece is worn by the user. Alternatively, the post may be replaced with a first VELCRO® brand fastener and a portion of the support strap may have a second VELCRO® brand fastener capable of mating engagement with the first VELCRO® brand fastener for securing the apparatus to the headpiece.

In yet another exemplary embodiment of the apparatus, the apparatus includes a cradle spaced-apart from a base that rests on the brim of the headpiece. The base includes at least one clip for attaching the base and, hence, the apparatus to the brim of the headpiece. A rotator assembly is coupled to the cradle and the base for rotating and tilting the cradle relative to the base. In order to achieve this result, the rotator assembly includes a ball-and-socket joint or a heim joint. In this manner, rotation and tilt of the electronic device can be selectively varied to appropriately capture a desired image.

In still another exemplary embodiment of the apparatus, a mount is connected to the clip for mounting the electronic device on the clip. In an exemplary configuration of the mount, a knob or adjustment disk belonging to the mount is used to tighten-up against the electronic device, so that the electronic device does not rotate once the electronic device is oriented as desired.

According to an aspect of the present invention, there is provided an apparatus for mounting an electronic device on a brim of a headpiece, comprising: a cradle defining a slot therein for receiving the electronic device; a retaining band coupled to the cradle, the retaining band being adapted to retain the electronic device in the slot defined by the cradle; and a clip coupled to the cradle, the clip being adapted to engage the brim, whereby the electronic device is mounted on the brim while the clip is coupled to the cradle and engages the brim for coupling the cradle to the brim, while the slot defined by the cradle receives the electronic device and while the retaining band retains the electronic device in the slot defined by the cradle.

According to another aspect of the present invention, there is provided an apparatus for mounting an electronic device on a brim of a headpiece, comprising: a clip having a C-shaped first end portion for retaining the electronic device and a U-shaped second end portion for engaging the brim; and a bracket coupled to the C-shaped first end portion for receiving the electronic device, whereby the electronic device is mounted on the brim while the C-shaped first end portion retains the electronic device, while the bracket receives the electronic device, and while the U-shaped second end portion of the clip engages the brim.

According to yet another aspect of the present invention, there is provided an apparatus for mounting an electronic device on a brim of a headpiece, comprising a clip adapted to support the electronic device, the clip including a movable locking arm for releasably locking the clip to the brim, whereby the electronic device is mounted on the brim while the clip supports the electronic device and while the locking arm releasably locks the clip to the brim.

According to yet another aspect of the present invention there is provided an apparatus for mounting an electronic device on a brim of a headpiece, comprising a clip adapted to support the electronic device, the clip including a flexible leaf spring having a ridge thereon for engaging the brim, whereby the electronic device is mounted on the brim while the clip supports the electronic device and while the ridge engages the brim.

According to still another aspect of the present invention, there is provided an apparatus for mounting an electronic device on a brim of a headpiece, comprising: a U-shaped clip having a first leg and a second leg integrally formed with the first leg; and a mount coupled to the first leg for mounting the electronic device on the first leg, wherein the mount is adapted to accept devices attachable to a tripod head mount mechanism configured to adjustably retain the electronic device.

According to a further aspect of the present invention, there is provided an apparatus for mounting an electronic device on a brim of a headpiece, comprising a clip adapted to support the electronic device, the clip including a pivotable locking arm releasably engageable with the brim for releasably locking the clip to the brim, whereby the electronic device is releasably mounted on the brim while the clip supports the electronic device and while the locking arm releasably locks the clip to the brim.

According to an additional aspect of the present invention, there is provided an apparatus for mounting an electronic device on a brim of a headpiece, comprising a clip adapted to support the electronic device, the clip including a flexible leaf spring having an end portion for flexing the leaf spring and having a ridge thereon for engaging the brim, whereby the electronic device is mounted on the brim while the clip supports the electronic device, while the end portion flexes the leaf spring and while the ridge engages the brim.

According to a further aspect of the present invention, there is provided a method of manufacturing an apparatus for mounting an electronic device on a brim of a headpiece, comprising the steps of: providing a cradle defining a slot therein for receiving the electronic device; coupling a retaining band to the cradle, the retaining band being adapted to retain the electronic device in the slot defined by the cradle; and coupling a clip to the cradle, the clip being adapted to engage the brim, whereby the electronic device is mounted on the brim while the clip is coupled to the cradle and engages the brim, while the slot defined by the cradle receives the electronic device and while the retaining band retains the electronic device in the slot defined by the cradle.

A feature of the present invention is the provision of a cradle adapted to receive an electronic device, such as a smartphone or camcorder.

Another feature of the present invention is the provision of a retaining band coupled to the cradle and adapted to span the electronic device for retaining the electronic device in the cradle.

An additional feature of the present invention is the provision of a clip coupled to the cradle for engaging the brim, so that the electronic device is mountable on the brim.

A further feature of the present invention is the provision of a clip having a C-shaped first end portion for retaining the electronic device, a U-shaped second end portion integrally formed with the C-shaped first end portion for engaging the brim of the headpiece, and a bracket coupled to the C-shaped first end portion for receiving the electronic device retained by the C-shaped first end portion.

A further feature of the present invention is the provision of a clip comprising a movable locking arm engageable with the brim of the headpiece for releasably locking the clip to the brim of the headpiece.

Another feature of the present invention is the provision of a clip comprising a leaf spring having a ridge thereof engageable with the brim of the headpiece for releasably securing the clip to the brim of the headpiece.

Yet another feature of the present invention is the provision of a support strap coupled to the cradle for supporting the cradle on the headpiece.

Still another feature of the present invention is the provision of rotator assembly coupled to the cradle and the clip for rotating the cradle relative to the clip.

Another feature of the present invention is the provision of a mount connected to the clip for mounting the electronic device on the clip.

In addition to the foregoing, various other method and/or device aspects and features are set forth and described in the teachings, such as text (e.g., claims and/or detailed description) and/or drawings of the present invention.

The foregoing is a summary and thus may contain simplifications, generalizations, inclusions, and/or omissions of detail. Consequently, those skilled in the art will appreciate that the summary is illustrative only and is not intended to be in any way limiting. In addition to the illustrative aspects, embodiments, and features described hereinabove, further aspects, embodiments, and features will become apparent by reference to the drawings and the following detailed description.

BRIEF DESCRIPTION OF THE SEVERAL VIEWS OF THE DRAWINGS

The invention will be more fully understood by reference to the detailed description in conjunction with the following figures, wherein.

DETAILED DESCRIPTION OF THE INVENTION

Figure 1:
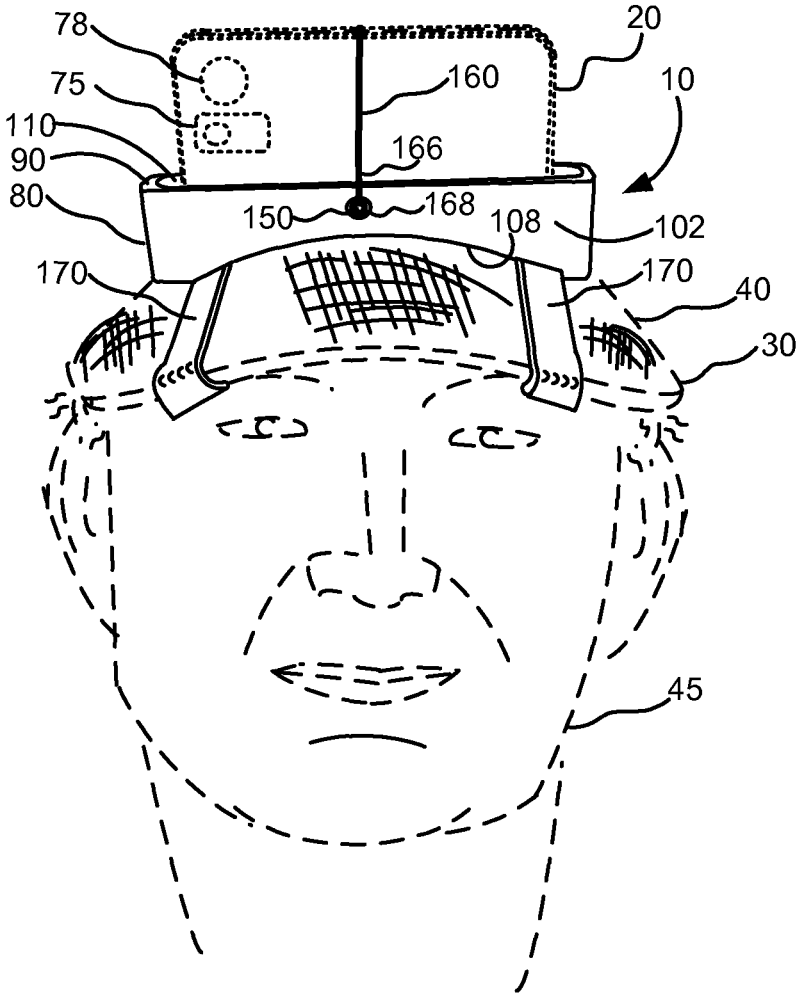
FIG. 1 is a view in perspective of a first embodiment apparatus mounted on a brim of a headpiece, which may be a baseball cap, worn by a user of the apparatus, the first embodiment apparatus having an electronic device coupled thereto.
Figure 2:
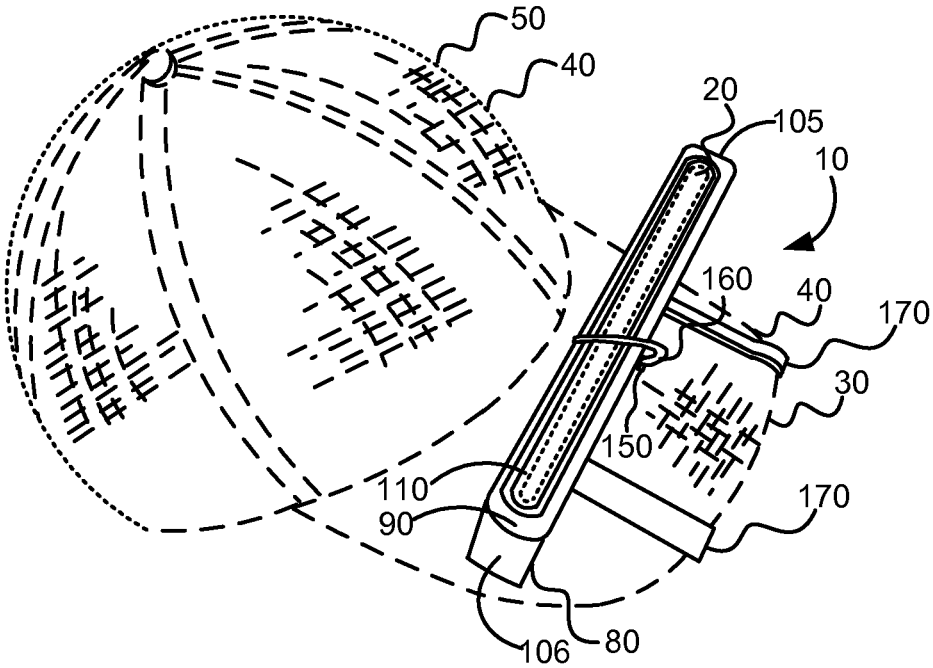
FIG. 2 is another view in perspective of the first embodiment apparatus mounted on the brim of the headpiece, which may be a baseball cap.
Figure 3:
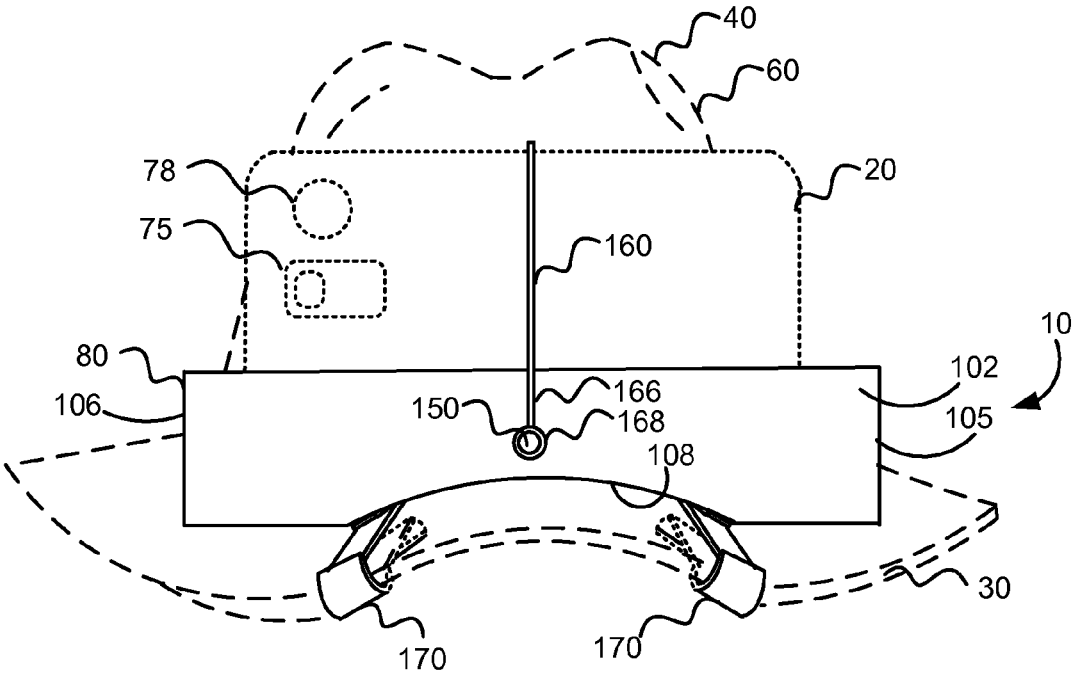
FIG. 3 is yet another view in perspective of the first embodiment apparatus mounted on the brim of the headpiece, which may be a fedora hat.
Figure 4:
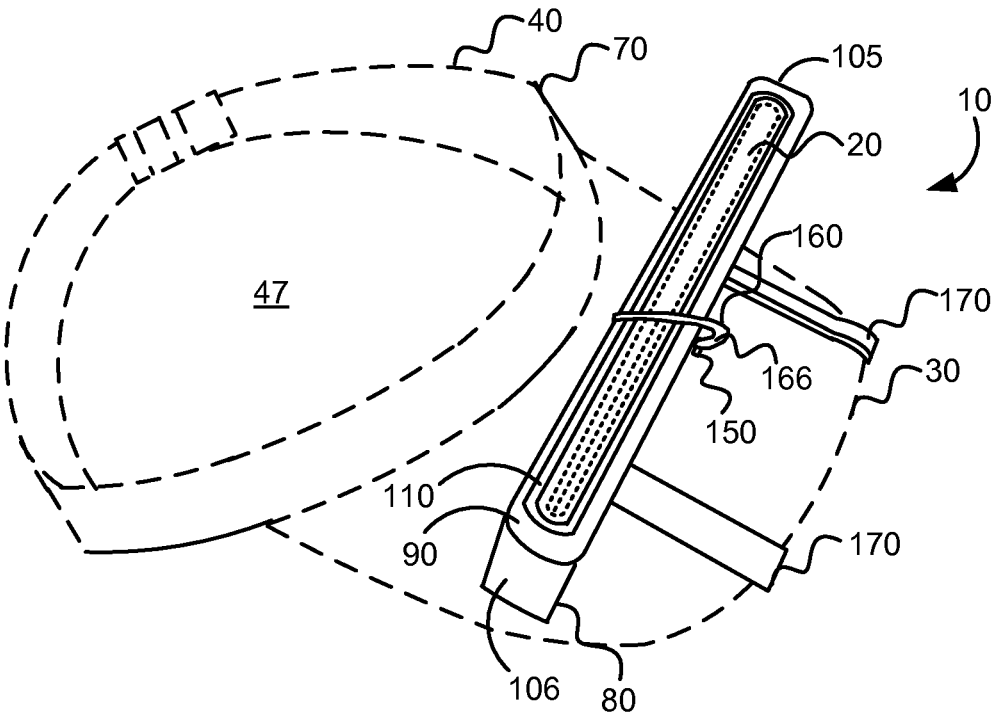
FIG. 4 is a still another view in perspective of the first embodiment apparatus mounted on the brim of the headpiece, which may be a visor.
Figure 4A:
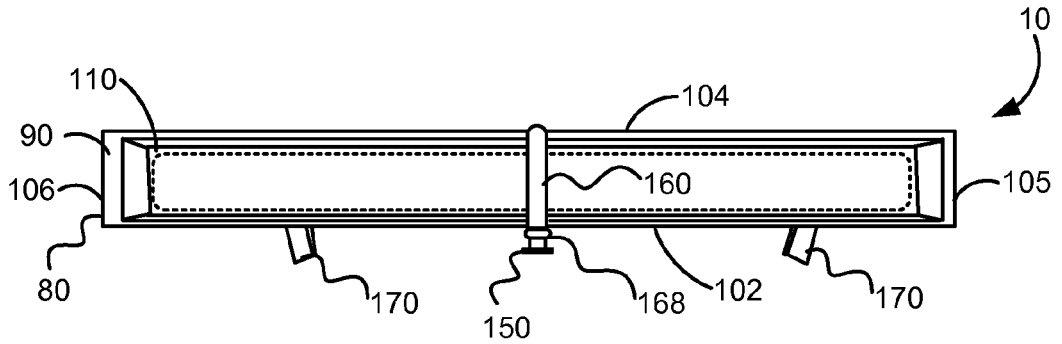
FIG. 4A is a top plan view of the first embodiment apparatus.
Figure 4B:
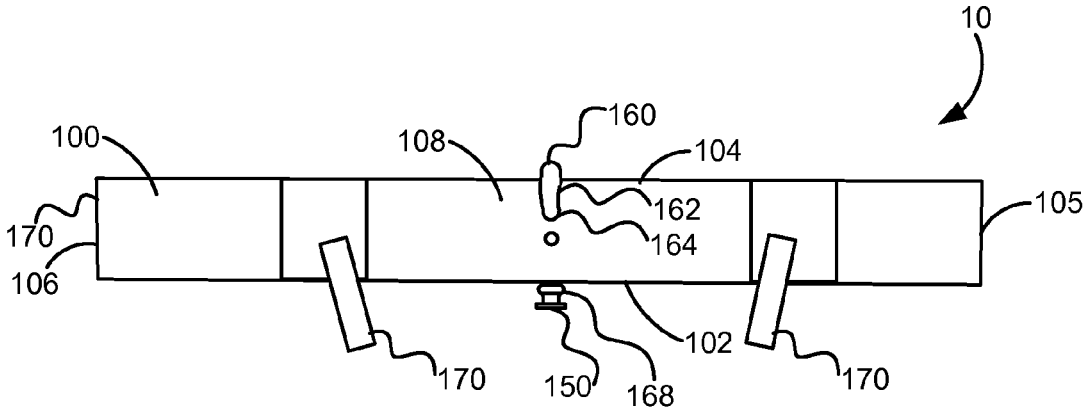
FIG. 4B is a bottom plan view of the first embodiment apparatus.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from either the spirit or scope of the invention.

In addition, the present patent specification uses formal outline headings for clarity of presentation. However, it is to be understood that the outline headings are for presentation purposes, and that different types of subject matter may be discussed throughout the application (e.g., device(s)/structure(s) may be described under process(es)/operations heading(s) and/or process(es)/operations may be discussed under structure(s)/process(es) headings; and/or descriptions of single topics may span two or more topic headings). Hence, the use of the formal outline headings is not intended to be in any way limiting.

Figure 25:
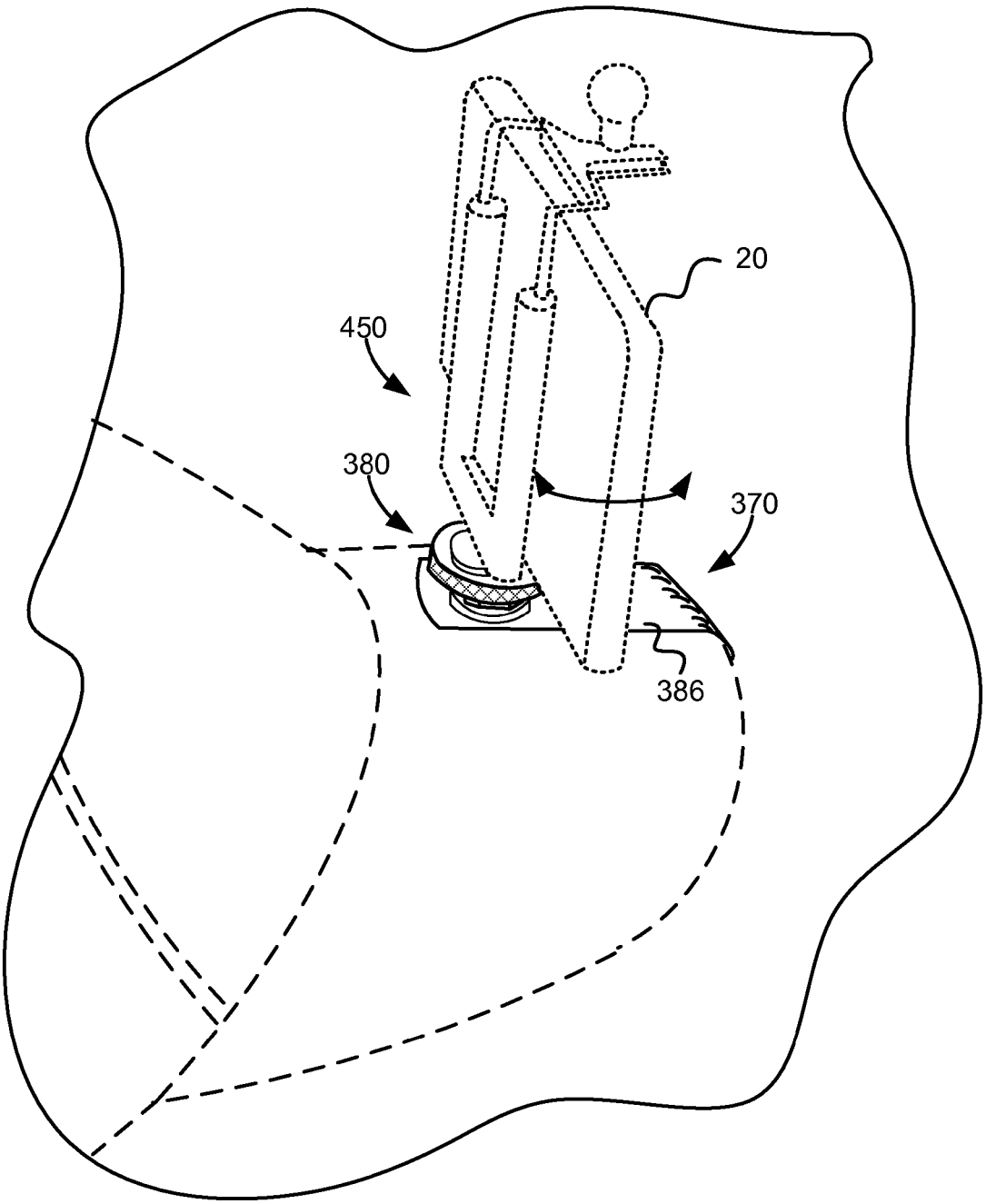
FIG. 25 is a fragmentary view in perspective of the another alternative configuration of the clip including the mount, this view showing an adjustable electronic device tripod mount mechanism coupled to the mount for mounting and rotatably adjusting the position of the electronic device.

Therefore, with reference to FIGS. 1, 2, 3, 4, 4A and 4B, there is shown a first embodiment apparatus, generally referred to 10, for mounting an electronic device 20 on an outwardly projecting bill, peak or brim 30 of a headpiece 40. The headpiece 40 is worn on the head of a wearer 45. For that purpose, headpiece 40 defines an interior space 47 to accommodate the head of wearer 45. First embodiment apparatus 10 (hereinafter referred to as "apparatus 10") allows hands-free recording and/or transmission of video and audio pertaining to objects (not shown) and events (not shown) in a multiplicity of venues (also not shown). Headpiece 40 may be any brimmed headpiece, such as a baseball cap 50, a fedora 60, a visor 70, or other brimmed headpiece. Headpiece 40 forms no part of the present invention, except when made, used, offered for sale, sold, or imported in combination with a clip 170 (e.g., see FIG. 1). In addition, headpiece 40 may be made of any suitable material, such as cloth, compressed wool or synthetic felt fibers, metal, polymer plastic, leather, straw or combinations thereof. Electronic device 20 may be a cellular telephone, such as a commercially available "smartphone." Such a commercially available smartphone provides digital image and voice services and typically has one or more software applications installed therein. The installed software applications provide Internet access, text messaging, electronic mail (i.e., e-mail), Web browsing, still and video image capture, electronic transmission of still and video images, still and video image playback, digital audio player capability (e.g., in the form of an MP3 player software application also commonly referred to as MPEG-1 or MPEG-2 Audio Layer III player capability), and other functions. Electronic device 20, which may be the previously mentioned commercially available smartphone, forms no part of the present invention, except when made, used, offered for sale, sold, or imported in combination with clip 170 (e.g., see FIGS. 1 and 25). Alternatively, electronic device 20 may be a commercially available camcorder in the form of a small portable combined camera and video/audio recording device used to capture both video and audio. Such a commercially available camcorder forms no part of the present invention, except when made, used, offered for sale, sold, or imported in combination with clip 170 (e.g., see FIG. 1).

Previously mentioned electronic device 20, whether a smartphone or camcorder or similar electronic device, includes an externally exposed optical lens 75 through which images are recorded onto electronic image sensors (not shown) contained within electronic device 20. As well known in the art of image capture devices, such an electronic image sensor may be a Charged Couple Device sensor (i.e., CCD sensor) or a Complementary Metal-Oxide Semiconductor sensor (i.e., CMOS sensor) and may be battery powered, solar-powered or powered by another energy source. Previously mentioned electronic device 20 also includes an externally exposed microphone 78 through which sounds are recorded. As well known in the art of sound capture devices, the sound may be captured by microphone 78 using suitable electronic circuitry (not shown), such as a Digital Controlled Amplifier (i.e., DCA), Voltage Controlled Amplifier (i.e., VCA), Analogue to Digital Converter (i.e., ADC) and/or other suitable electronic circuitry connected to microphone 78. Such electronic circuitry may be battery powered, solar-powered or powered by another energy source.

Referring to FIGS. 1, 2, 3, 4, 4A, 4B, 5, 5A and 6, apparatus 10 comprises a generally parallelepiped-shaped cradle 80 having a top surface 90, a bottom surface 100, a front surface 102, a rear surface 104, a first side surface 105 and a second side surface 106. If desired, a portion of bottom surface 100 has an arcuate-shaped cut-out 108 substantially conforming to a downward convex curvature of brim 30, if brim 30 has downward convex curvature.

Figure 5:
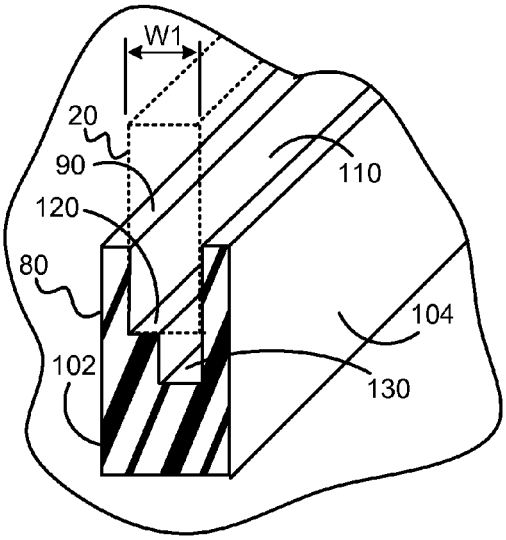
FIG. 5 is an orthogonal view in transverse cross-section of a cradle belonging to the first embodiment apparatus, the cradle defining an open slot therein having a generally step-shaped profile for receiving electronic devices of various thicknesses, an electronic device being shown resting on an upper step of the slot.
Figure 5A:
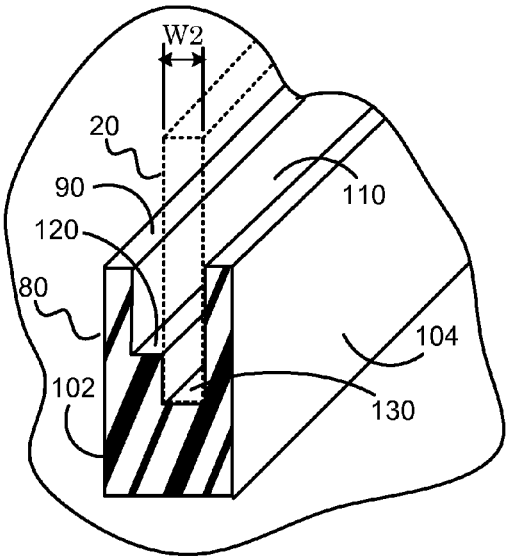
FIG. 5A is an orthogonal view in transverse cross-section of the cradle belonging to the first embodiment apparatus, the cradle defining an open slot therein having a generally step-shaped profile for receiving electronic devices of various thicknesses, an electronic device being shown resting on a lower step or landing of the slot.
Figure 6:
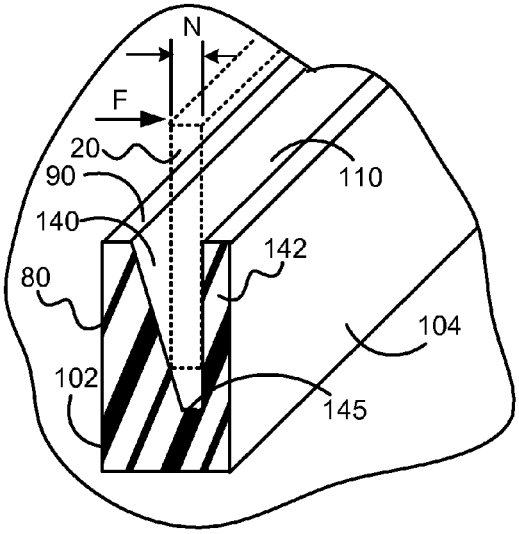
FIG. 6 is an orthogonal view in transverse cross-section of an alternative cradle belonging to the first embodiment apparatus, the cradle defining an open slot therein having a generally V-shaped profile for receiving electronic devices of various thicknesses.
Figure 7:
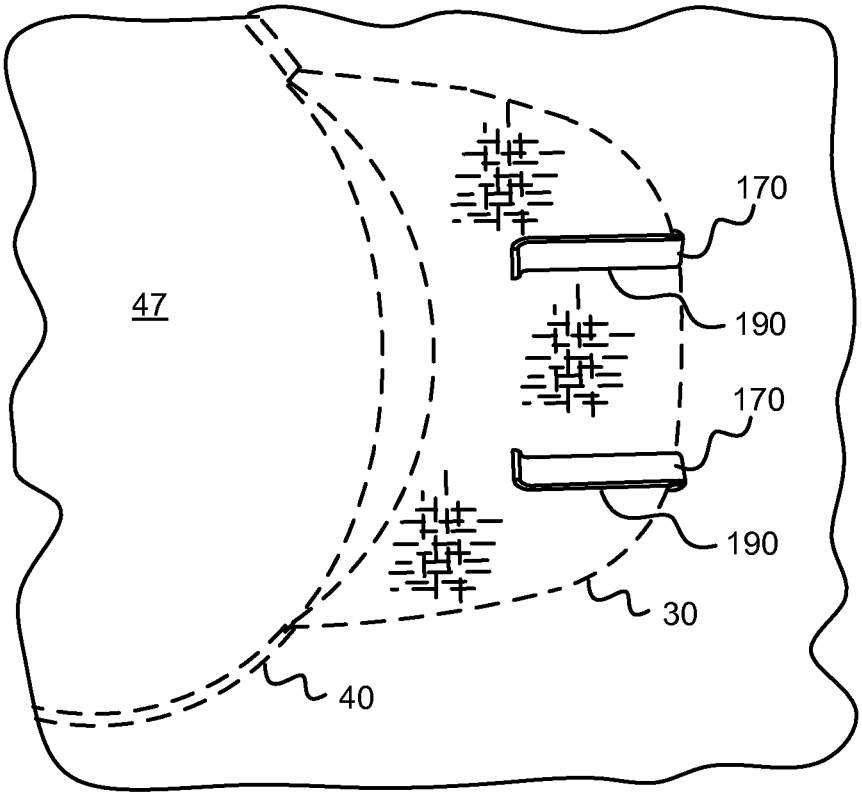
FIG. 7 is a bottom plan view of the headpiece, this view showing a pair of clips belonging to the first embodiment apparatus engaging the brim of the headpiece.
Figure 8:
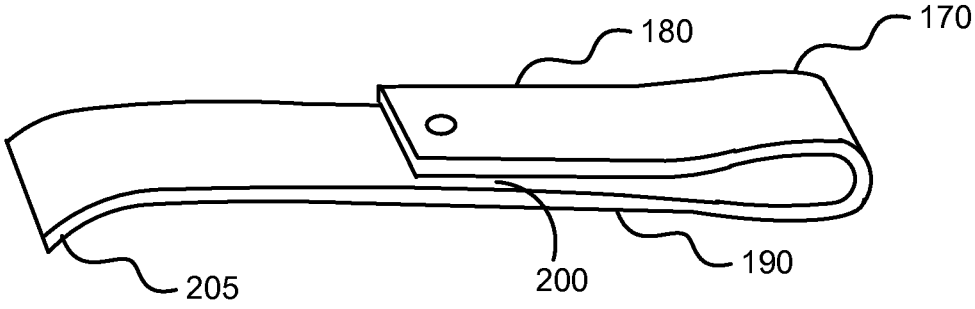
FIG. 8 is a view in perspective of an individual one of the pair of clips.

As best seen in FIGS. 5, 5A and 6, top surface 90 of cradle 80 defines a longitudinal groove or slot 110 therein for receiving electronic device 20 into cradle 80. By way of example only, and not by way of limitation, slot 110 may have any of a plurality of contours or profiles in transverse cross-section. For example, slot 110 may have a generally step-shaped transverse cross-sectional profile defined by a ledge or step 120 and a landing 130 (see FIGS. 5 and 5A) for receiving electronic devices of different edgewise, transverse cross-sectional thicknesses. For example, in the event electronic device 20 has a wide transverse cross-sectional thickness "W1" (see FIG. 5); then, in such event, a lengthwise side edge of electronic device 20 will rest on step 120 when electronic device 20 is received in slot 110. However, the generally step-shaped profile of slot 110 is versatile. In this regard, in the event electronic device 20 has a transverse cross-sectional thickness "W2" that is less than thickness "W1" (see FIG. 5A); then, in such event, the lengthwise side edge of electronic device 20 will rest on landing 130 when electronic device 20 is received in slot 110. Optionally, slot 110 may have a generally V-shaped transverse profile defined by a sloped wall 140 and an opposite vertical wall 142 joined by a horizontal floor or landing 145 (see FIG. 6). The lengthwise edge of electronic device 20 will downwardly slide along sloped wall 140 and come to rest in slot 110 and be firmly fitted or seated in slot 110. An electronic device 20 that has a narrow transverse cross-sectional thickness "N" (see FIG. 6) will slide further down the slot than one with a wider transverse cross-sectional thickness; however, the V-shaped transverse profile of slot 110 can accommodate and firmly hold electronic devices having various thicknesses.

Referring again to FIGS. 1, 2, 3, 4, 4A, 4B, 5, 5A and 6, if cradle 80 is formed from a metal (e.g., light-weight aluminum) blank or a wood blank, then slot 110 can be formed by a milling operation during the manufacturing process. Also, if cradle 80 is formed from a metal, then slot 110 can be formed by a forging or casting operation, rather than by a milling operation, during the manufacturing process. Alternatively, if cradle 80 is formed from a polymer plastic, then slot 110 can be formed when cradle 80 is made by an injection mold or extrusion mold operation during the manufacturing process. By way of example only, and not by way of limitation, the polymer plastic material used during the manufacturing process may be selected from the group consisting essentially of polystyrene, polyvinyl chloride, polyamine (e.g., nylon), natural rubber, synthetic rubber, and combinations thereof.

With reference to FIGS. 1, 2, 3, 4, 4A and 4B, a post 150, such as in the form of a brad, is affixed to front surface 102 of cradle 80 and outwardly projects therefrom for reasons disclosed presently. In this regard, an elongate retaining band 160 has a first end portion 162 affixed to a retaining point 164 located on the bottom surface 100 of cradle 80. First end portion 162 is affixed to retaining point 164 by means of a suitable permanent adhesive (not shown), such as an adhesive selected from the group consisting essentially of an epoxy adhesive, an acrylic adhesive, a cyanoacrylate adhesive, and combinations thereof. Retaining band 160 also has a second end portion 166 formed in a loop 168 adapted to removably surround post 150, such that loop 168 releasably secures second end portion 166 to post 150. To achieve this result, loop 168 may be elastic, so that loop 168 can be circumferentially expanded manually and placed around post 150 and then manually released, in order that loop 168 circumferentially contracts to embrace post 150. The steps mentioned immediately hereinabove are performed in reverse in order to remove loop 168 and, therefore, retaining band 160 from post 150.

Alternatively, retaining band 160 can have a male (or female) hook-and-loop fastener end portion (not shown) rather than loop 168. The hook-and-loop fastener end portion is engageable with a female (or male) hook-and-loop fastener (also not shown) that is used rather than post 150. In this regard, the hook-and-loop fasteners may be "VELCRO® brand" hook-and-loop fasteners, which may comprise a fabric made of "TEFLON®", nylon, polyester or other suitable material. "VELCRO® brand" is a registered mark of Velcro USA, Incorporated located in Manchester, N.H., USA. "TEFLON®", which comprises polytetrafluoroethylene, is a registered mark owned by E.I. du Pont de Nemours and Company located in Wilmington, Del., U.S.A.

Referring again to FIGS. 1, 2, 3, 4, 4A and 4B, in order to retain electronic device 20 in slot 110, retaining band 160 is extended from retaining point 164, spanned across electronic device 20 and releasably secured to post 150 by means of loop 168. In this manner, retaining band 160 in combination with the previously mentioned transverse profile of slot 110 retains and stabilizes electronic device 20 in slot 110. It should be appreciated that retaining band 160 will tend to exert a horizontally-acting force "F" (see FIG. 6) on electronic device 20, such that the horizontally-acting force "F" will lean electronic device 20 upright against previously mentioned vertical wall 142 of cradle 80 while electronic device resides in slot 110. Retaining band 160 can be manufactured from a substantially elastic material (e.g., natural rubber, synthetic rubber, nylon), to accommodate various widths and thicknesses of electronic device 20. Alternatively, retaining band 160 can be manufactured from a substantially inelastic material (e.g., metal wire or cloth fabric rope), except for elastic loop 168, and sized to custom fit a particular width and thickness of electronic device 20. Alternatively, as previously mentioned, loop 168 may be replaced by a VELCRO® brand fastener arrangement.

As shown in FIGS. 1, 2, 3, 4, 4A, 4B, 7 and 8, one or more generally U-shaped spaced-apart clamps or clips 170, and desirably at least two spaced-apart U-shaped clamps or clips 170, are affixed to bottom surface 100 of cradle 80 by a bolt, screw or permanent adhesive, such that each clip 170 outwardly extends from cradle 80, as shown. Each U-shaped clip includes a first leg 180 and a second leg 190 (see FIG. 8) disposed opposite first leg 180. Second leg 190 is integrally formed with first leg 180 from a metal or plastic blank folded to form U-shaped clip 170 during manufacture of U-shaped clip 170. First leg 180 and second leg 190 define a gap 200 therebetween sized to slidably, snugly and matingly receive brim 30. If desired, second leg 190 can have a curved end portion 205 to more easily slide brim 30 into and out of gap 200. First leg 180 and second leg 190 are manually and outwardly bendable away from each other, so that gap 200 can be widened. Widening gap 200 allows brim 30 to be received into gap 200. When first leg 180 and second leg 190 are manually released after brim 30 is received in gap 200, the elastic characteristic of first leg 180 and second leg 190 will cause first leg 180 and second leg 190 to move toward each other in order to return to their original positions. When first leg 180 and second leg 190 return to their original positions, first leg 180 and second leg 190 will grip or engage brim 30 of headpiece 40. The brim 30 will remain in gap 200 due to force of friction or clamping force exerted on brim 30 by legs 180/190. However, brim 30 is removed from gap 200 when wearer 45 pulls brim 30 from gap 200 with sufficient pulling force to overcome the force of friction and clamping force. In this manner, electronic device 20 is mounted on brim 30 while electronic device 20 is received into cradle 80, while retaining band 160 retains electronic device 20 in slot 110, and while each of U-shaped clips 170 releasably engages brim 30.

Figure 9:
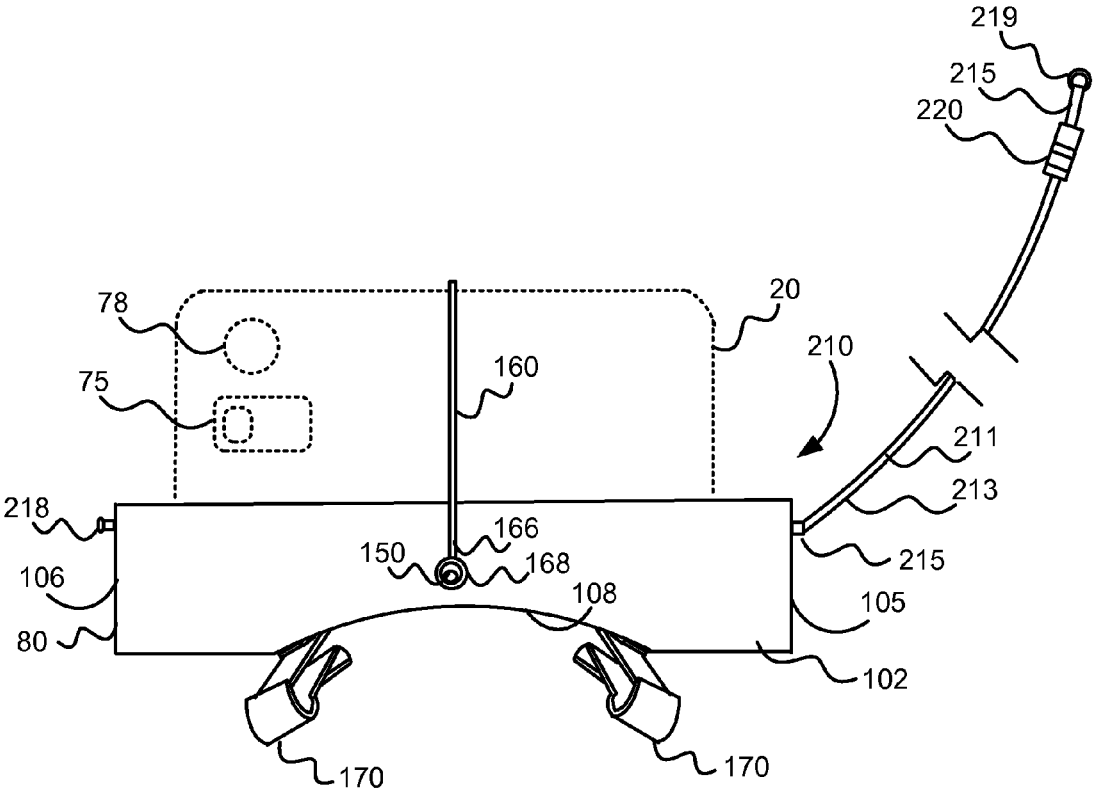
FIG. 9 is a view in perspective of a second embodiment apparatus, this view showing a support strap belonging to the second embodiment apparatus.
Figure 10:
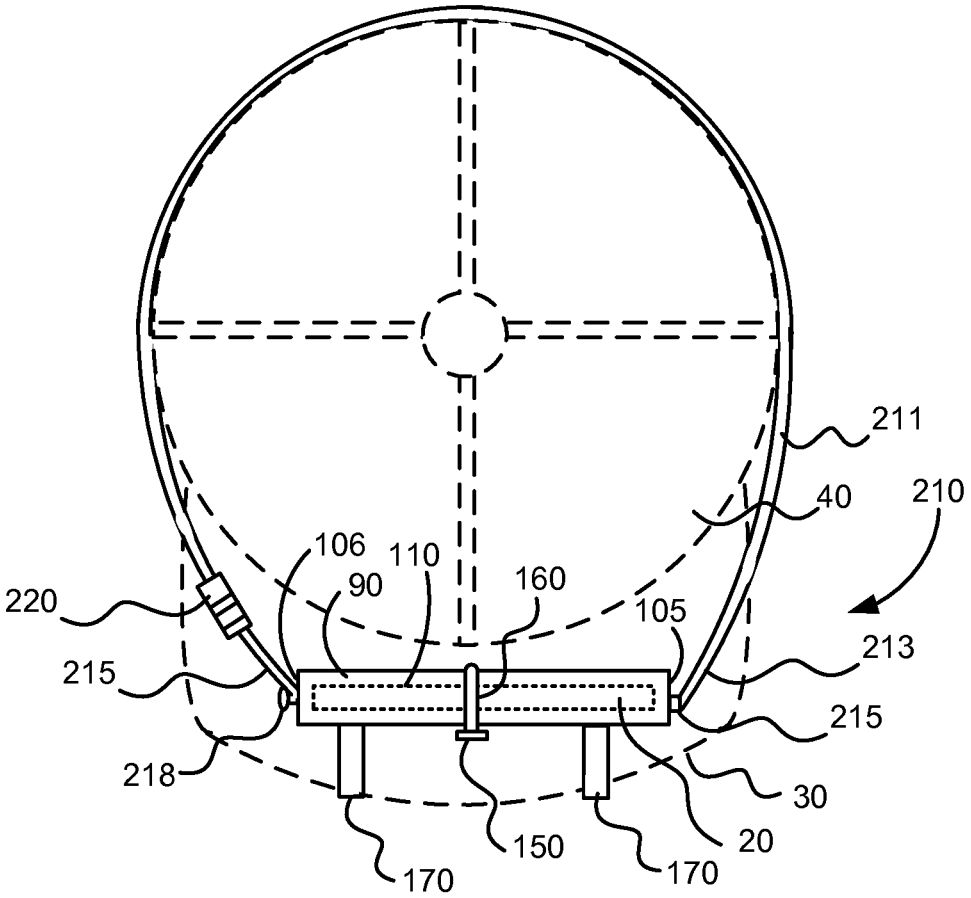
FIG. 10 is a top plan view of the second embodiment apparatus, this view showing the support strap circumferentially extending about the headpiece.
Figure 11:
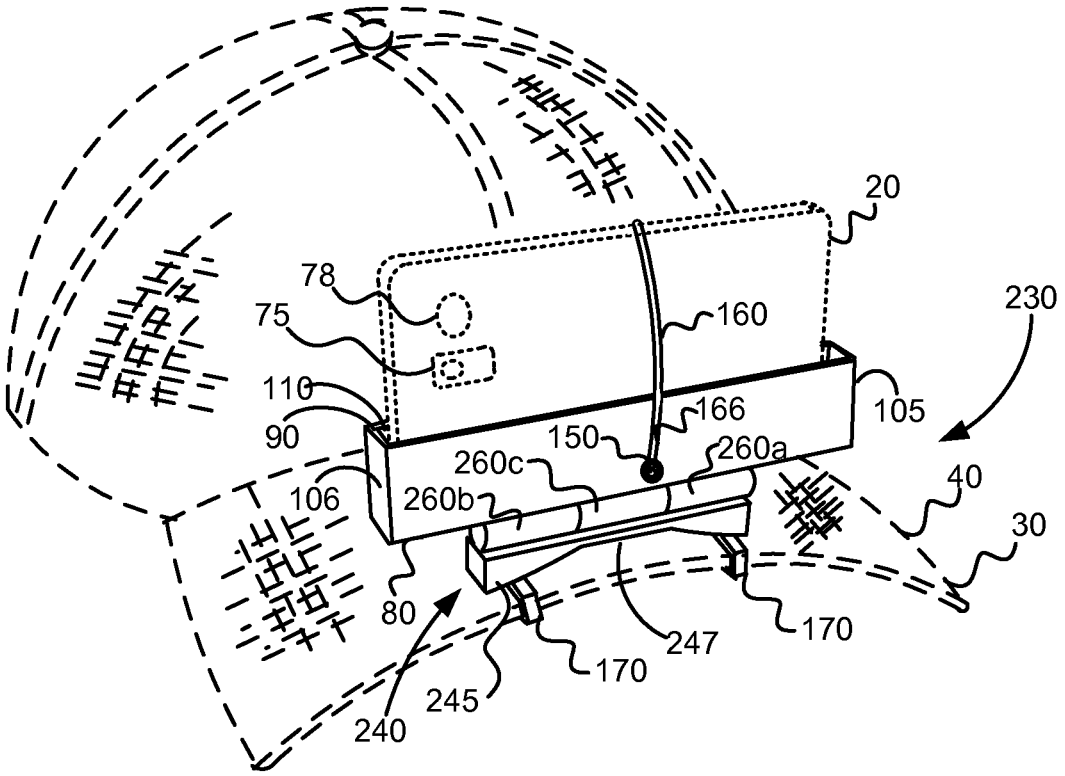
FIG. 11 is a view in perspective of a third embodiment apparatus, the third embodiment apparatus including a rotator assembly interposed between the cradle and the pair of clips for rotating the cradle relative to the pair of clips.
Figure 12:
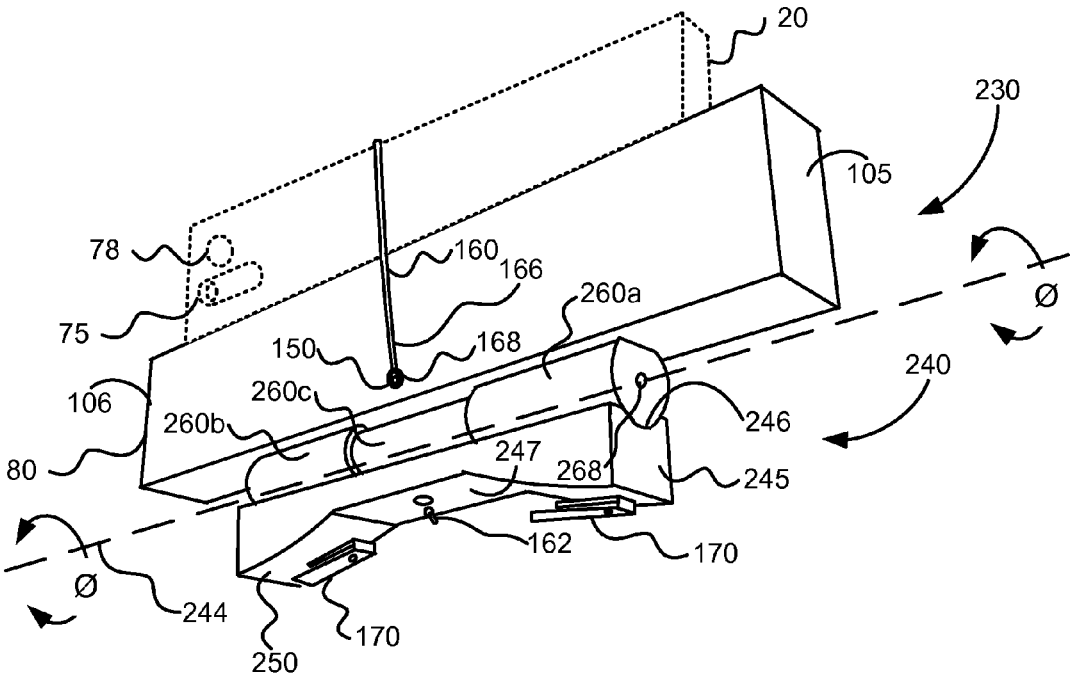
FIG. 12 is a view in perspective of the third embodiment apparatus, this view showing the rotator assembly adapted to rotate the cradle about one axis of rotation.
Figure 12A:
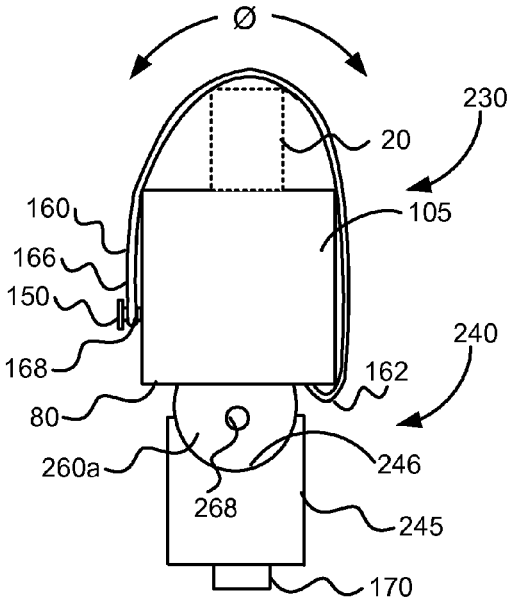
FIG. 12A is an edge view in elevation of the rotator assembly maintaining the cradle in an upright default position.
Figure 12B:
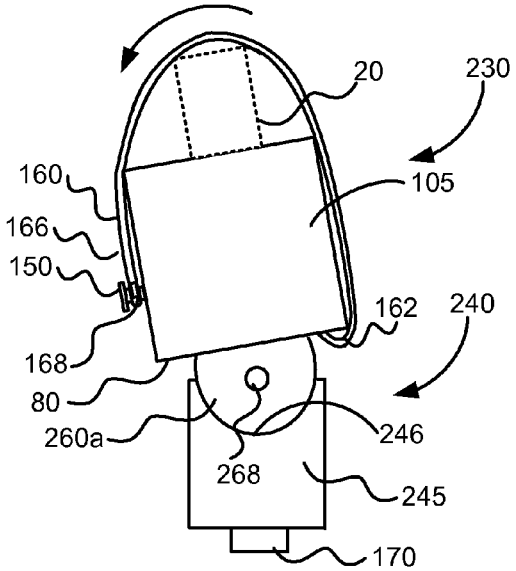
FIG. 12B is an edge view in elevation of the rotator assembly having rotated the cradle forwardly.
Figure 12C:
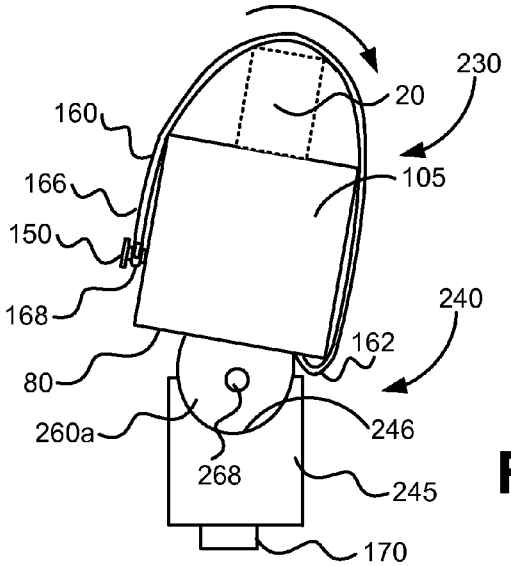
FIG. 12C is an edge view in elevation of the rotator assembly having rotated the cradle rearwardly.
Figure 12D:
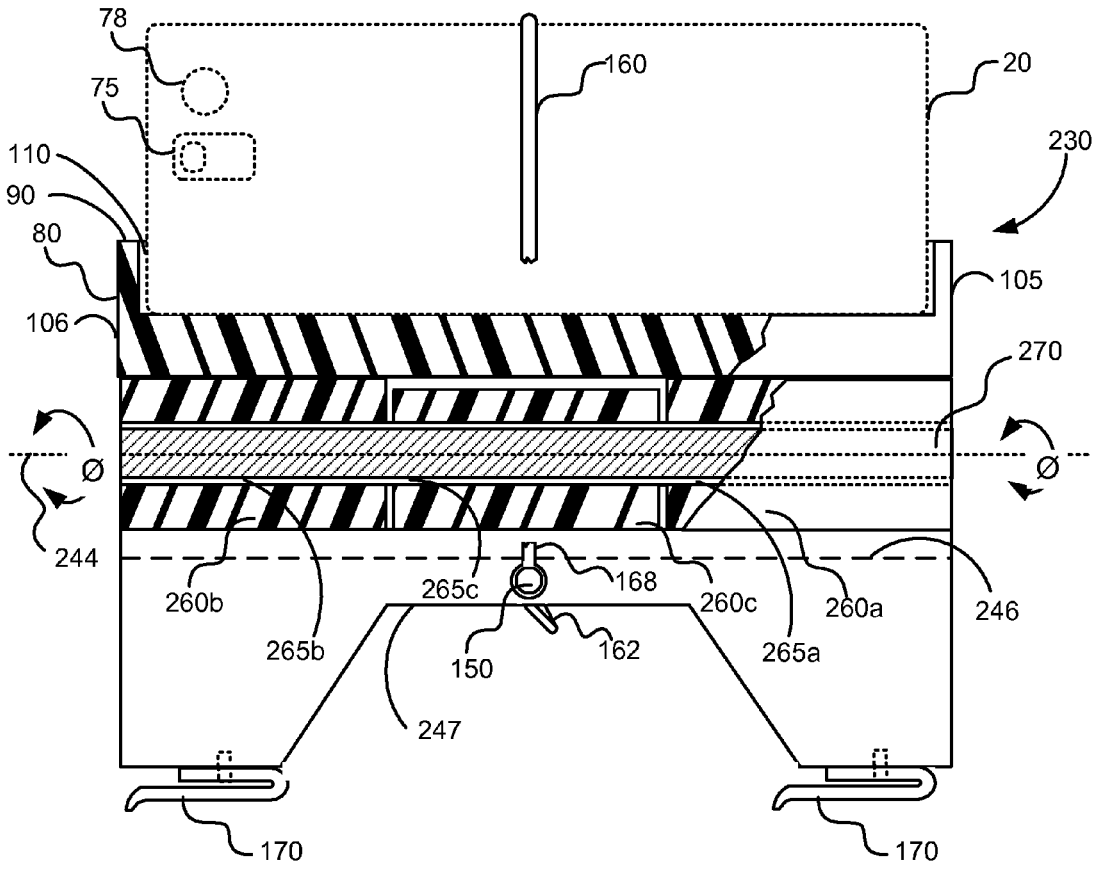
FIG. 12D is a view in partial elevation of the third embodiment apparatus.

Turning now to FIGS. 9 and 10, there is shown a second embodiment apparatus, generally referred to 210, for mounting electronic device 20 on outwardly projecting brim 30 of headpiece 40. Second embodiment apparatus 210 (hereinafter referred to as "apparatus 210") is similar to apparatus 10, except apparatus 210 comprises an elongate, elastic support strap 211. Support strap 211 is manufactured from any suitable elastic material, such as natural rubber, synthetic rubber, nylon, or the like. Support strap 211 has a first end portion 213 affixed to an anchor post 215 that outwardly projects from previously mentioned first side surface 105 of cradle 80. Alternatively, first end portion 213 may be affixed to first side surface 105 of cradle 80 by means of a suitable permanent adhesive or by means of a VELCRO® arrangement. In this case, anchor post 215 is not present. Support strap 211 also has a second end portion 217 terminating in an annular ring 219 that is adapted to be releasably secured to a support post 218. Support post 218 outwardly projects from previously mentioned second side surface 106 of cradle 80. Support strap 211 is adapted to elastically extend about headpiece 40 and be releasably secured to support post 218. Support strap 211 is releasably secured to support post 218 by means of a ring 219 or a hook (not shown). If desired, in the event support strap is manufactured from an inelastic material; then, in such event, support strap 211 can include an adjustment member or buckle arrangement 220 for adjusting length of support strap 211 to fit the circumference of headpiece 40. Presence of support strap 211 provides additional support for cradle 80 on headpiece 40 while clips 170 engage brim 30.

With reference to FIGS. 11, 12, 12A, 12B, 12C, there is shown a third embodiment apparatus, generally referred to as 230, for mounting electronic device 20 on outwardly projecting brim 30 of headpiece 40. Third embodiment apparatus 230 (hereinafter referred to as "apparatus 230") comprises previously mentioned cradle 80, but without cut-out 108 being formed in cradle 80 and without clips 170 being directly connected to cradle 80. Apparatus 230 further comprises a rotator assembly, generally referred to as 240, for rotating cradle 80 through an angle theta "Ø" about a horizontal axis 244. The angle theta "Ø" can assume a value of up to approximately 180 degrees. Rotator assembly 240 comprises a generally parallelepiped-shaped base 245 vertically aligned with cradle 80 and spaced-apart therefrom. Base 245 defines a cut-out 247 that substantially conforms to the downward convex curvature of brim 30, if brim 30 has downward convex curvature. Base 245 may also define a concave, longitudinal channel 246 therein for reasons provided hereinbelow. Channel 246 can be formed by a milling operation or channel 246 can be formed by a forging or casting operation. Alternatively, channel 246 can be formed in base 245 by an injection mold or extrusion mold process during manufacture of base 245, if base 245 is a polymer plastic. Pivotally connected to a bottom surface 250 of base 245 are previously mentioned clips 170, which clips 170 can be pivoted inwardly and outwardly, as described in detail hereinbelow.

Referring to FIGS. 12, 12A, 12B, 12C and 12D, rotator assembly 240 further comprises a plurality of horizontally-aligned cylinders, such as first cylinder 260*a*, second cylinder 260*b*, and third cylinder 260*c* that are disposed in channel 246, which is defined by base 245. First cylinder 260*a*, second cylinder 260*b* and third cylinder 260*c* define a centrally disposed first bore 265*a*, a centrally disposed second bore 265*b* and a centrally disposed third bore 265*c* therethrough, respectively. Extending through first bore 265*a*, second bore 265*b* and third bore 265*c* is an elongate, smooth shaft 268 for maintaining cylinders 260*a*/260*b*/260*c* in horizontal alignment. Smooth shaft 268 is centered on previously mentioned horizontal axis 244 that extends through bores 256*a*/256*b*/256*c*. First cylinder 260*a* and second cylinder 260*b* are affixed to cradle 80, such as by a suitable adhesive. Third cylinder 260*c*, on the other hand, is affixed to base 245. Thus, cylinders 260*a* and 260*b* are allowed to rotate about bar 268 in an arc indicated by previously mentioned angle theta "Ø" for reasons provided momentarily.

Referring again to FIGS. 12A, 12B, 12C and 12D, it should be appreciated that rotator assembly 240 allows adjustment of the inclination of electronic device 20. Adjusting inclination of electronic device 20 allows electronic device 20 to capture images and sounds of objects and events located on an upward or a downward angle with respect to wearer 45. More specifically, rotator assembly 240 allows rotation in the direction of angle theta "Ø" about horizontal axis 244 in order to adjust inclination of electronic device 20.

Figure 13:
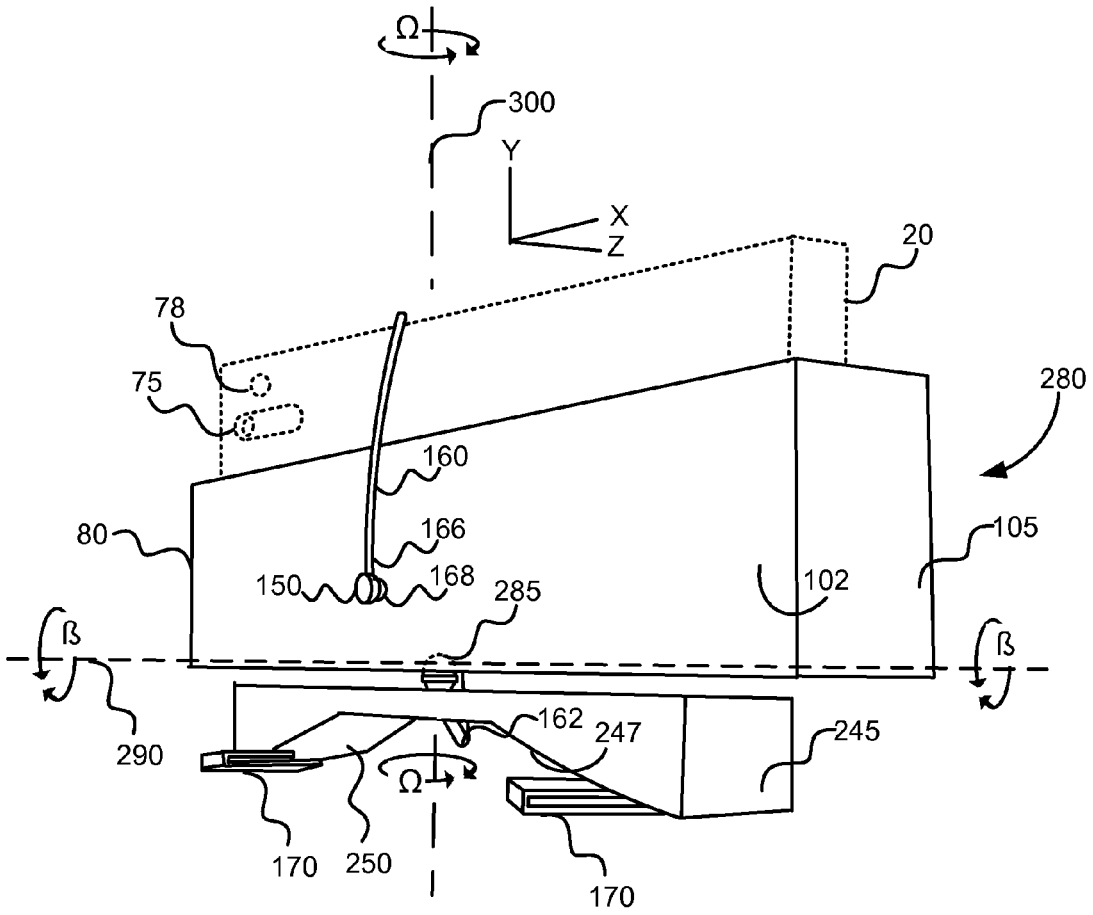
FIG. 13 is a view in perspective of a fourth embodiment apparatus, this view showing a cradle including a ball-and-socket joint or a heim joint that allows the cradle to rotate in an x-plane about a vertical axis omega "Ω" or in a y-plane about a horizontal axis beta "β"
Figure 14:
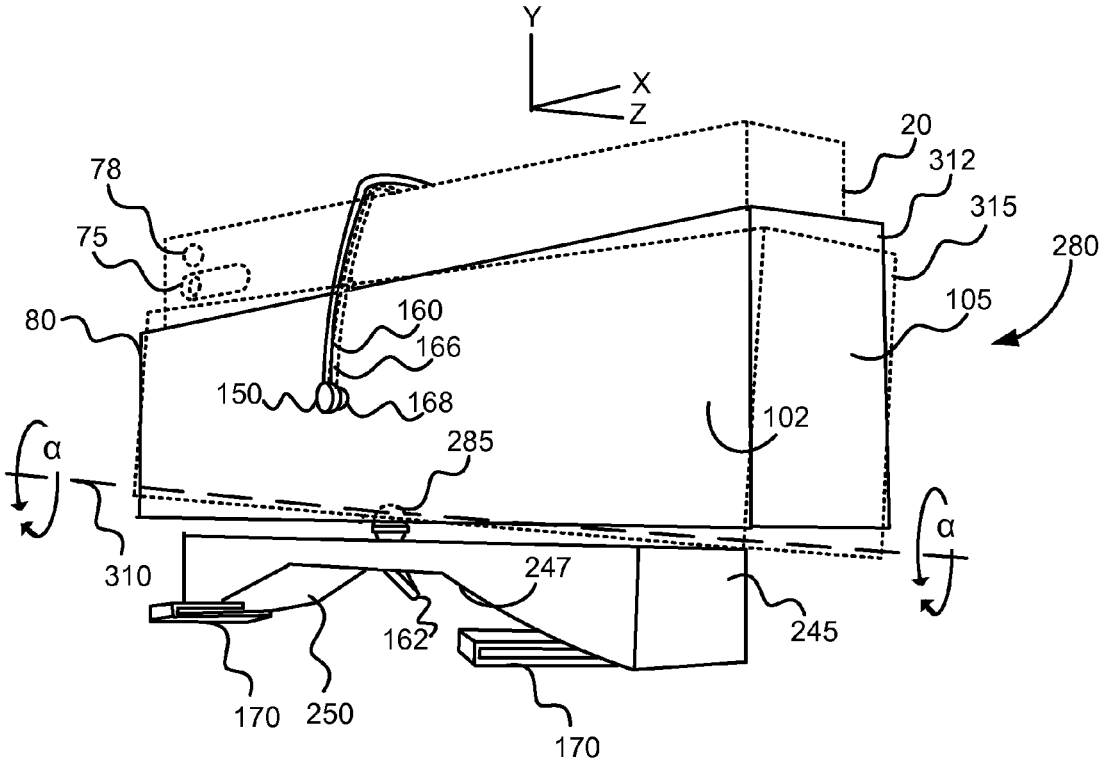
FIG. 14 is a view in perspective of the fourth embodiment apparatus, this view showing the cradle including the ball-and-socket joint or the heim joint that allows the cradle to tilt in a z-plane about a perpendicular axis alpha "α"

With reference to FIGS. 13 and 14, there is shown a fourth embodiment apparatus, generally referred to as 280, for mounting electronic device 20 on outwardly projecting brim 30 of headpiece 40. Fourth embodiment apparatus 280 (hereinafter referred to as "apparatus 280") comprises previously mentioned cradle 80, but without cut-out 108 being formed in cradle 80 and without clips 170 being connected directly to cradle 80. Previously mentioned base 245, which is disposed beneath cradle 80, is spaced-apart from and vertically aligned with cradle 80. Base 245 includes cut-out 247 and has previously mentioned clips 170 coupled to bottom surface 250 of base 245. A ball-and-socket joint or heim joint 285, as the case may be, is interposed between base 245 and cradle 80 and interconnects base 245 and cradle 80. Ball-and-socket joint or heim joint 285, as the case may be, allows rotation of cradle 80 about another horizontal axis 290 in the direction of an angle beta "β". Rotation of cradle 80 in the direction of angle beta "β" allows cradle 80 to be inclined forwardly and rearwardly relative to base 245 up to about 180 degrees. Ball-and-socket joint or heim joint 270, as the case may be, also allows rotation of cradle 80 about a vertical axis 300 in the direction of an angle omega "Ω." Rotation of cradle 80 in the direction of angle omega "Ω" allows cradle 80 to be rotated circularly about vertical axis 300 to a value of about 360 degrees. In addition, ball-and-socket joint or heim joint 270, as the case may be, also allows rotation of cradle 80 about another perpendicular axis 310 in the direction of an angle alpha "α." The axis 310 is perpendicular to cradle 80 when cradle 80 is in its default position (see FIG. 14). The default position of cradle 80 occurs when cradle 80 is vertically and horizontally aligned with base 245, as shown. Allowing rotation of cradle 80 about the another perpendicular axis 310 in the direction of angle alpha "α" allows cradle 80 to tilt side-to-side from a first position to a second position (shown in phantom in FIG. 14).

It is desirable that clips 170 be pivotally, outwardly extendable from underside or bottom surface 250 of base 245 in order to engage brim 30 of headpiece 40. Also, it is desirable that clips 170 be pivotally, inwardly retractable back to base 245 after the clips 170 are caused to disengage brim 30 of headpiece 40. Pivoting clips 170 inwardly to retract clips 170 back to bottom surface 250 of base 245 after being caused to disengage brim 30 of headpiece 40 reduces the outside spatial envelope of the apparatus. Reducing the outside spatial envelope of the apparatus allows the apparatus to be conveniently stored in pocket or purse.

Figure 15:
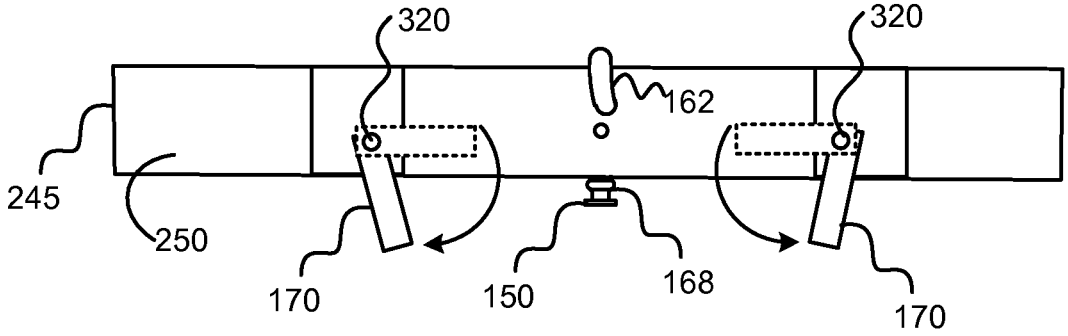
FIG. 15 is a bottom plan view of any of the first, second, third and fourth embodiment apparatus having a pair of clips pivotally extended outwardly from a bottom surface of the cradle.
Figure 16:
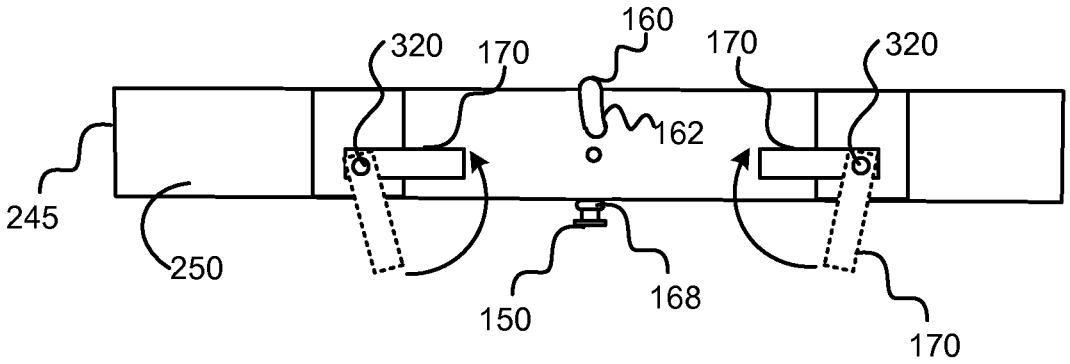
FIG. 16 is a bottom plan view of any of the first, second, third and fourth embodiment apparatus having the pair of clips pivotally retracted inwardly back to the bottom surface of the cradle.
Figure 17:
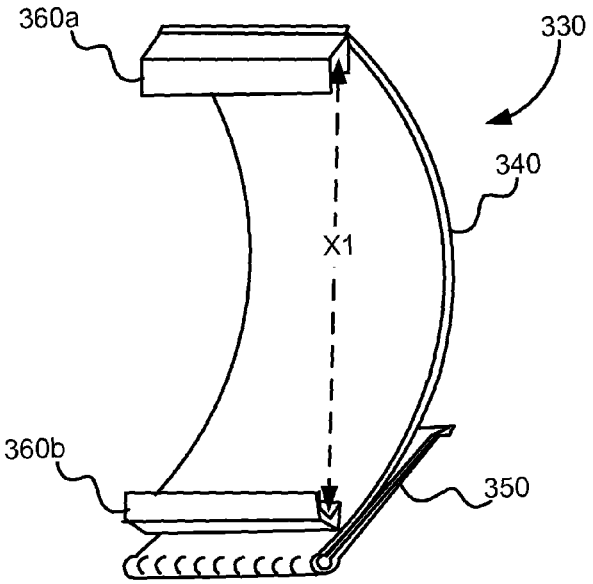
FIG. 17 is a view in perspective of an alternative configuration of the clip for coupling the cradle to the brim of the headpiece, this alternative configuration including a C-shaped first end portion having a pair of vertically spaced-apart brackets for releasably holding the electronic device therebetween, this alternative configuration also including a U-shaped second end portion for coupling the apparatus to the brim of the headpiece.
Figure 18:
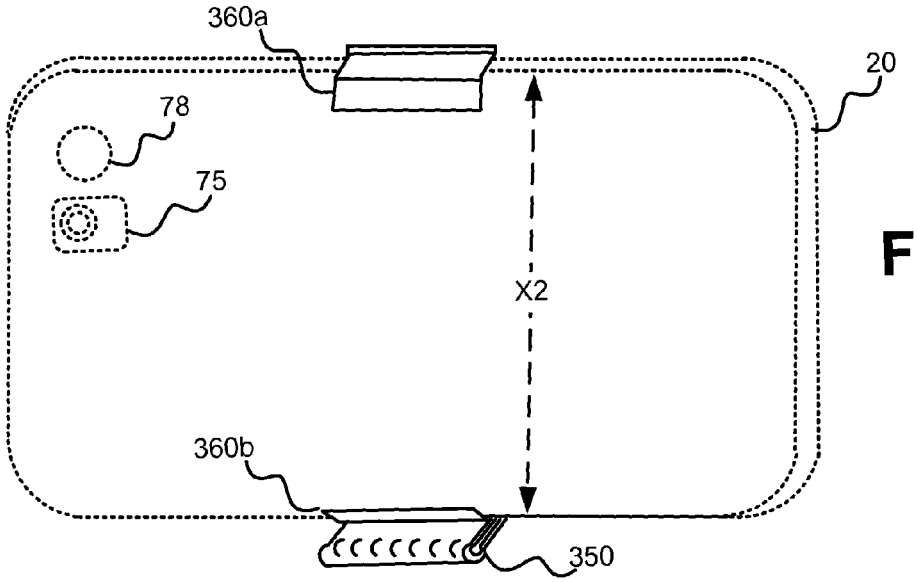
FIG. 18 is a another view in perspective of the alternative configuration of the clip, this view showing the pair of vertically spaced-apart brackets coupled to the C-shaped first end portion of the alternative configuration of the clip, the pair of brackets releasably securing the electronic device therebetween.
Figure 19:
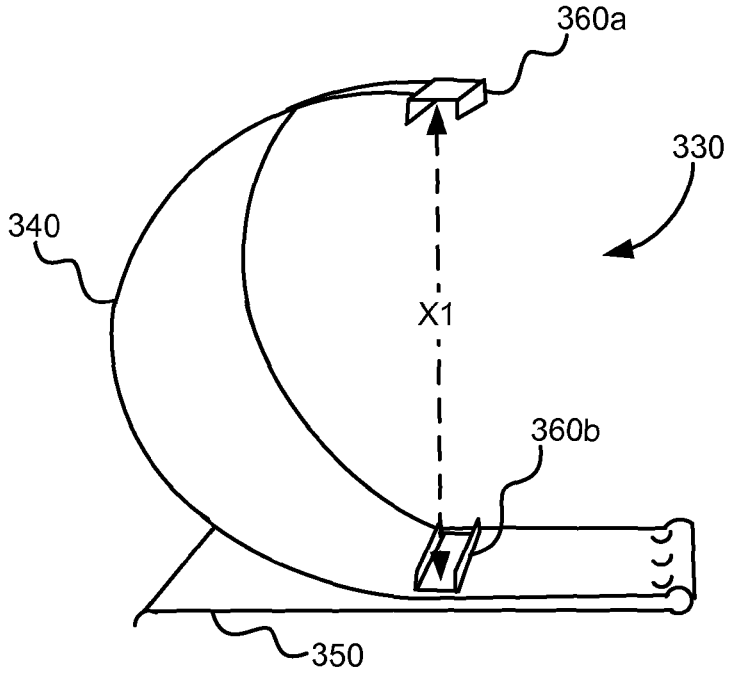
FIG. 19 is yet another view in perspective of the pair of vertically spaced-apart brackets coupled to the C-shaped first end portion of the alternative configuration of the clip.
Figure 20:
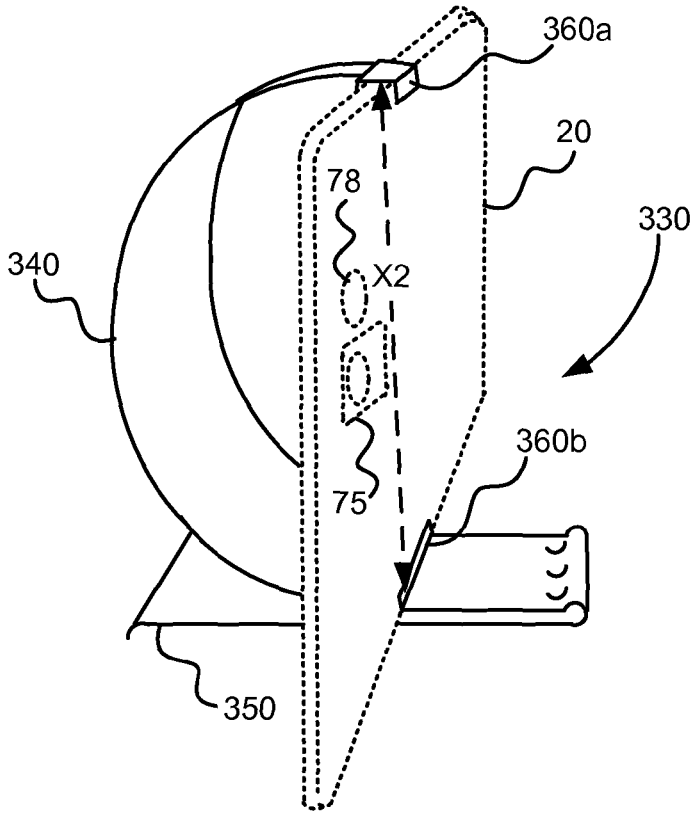
FIG. 20 is still another view in perspective of the pair of vertically spaced-apart brackets coupled to the C-shaped first end portion of the alternative configuration of the clip, the pair of brackets releasably securing the electronic device therebetween.
Figure 21:
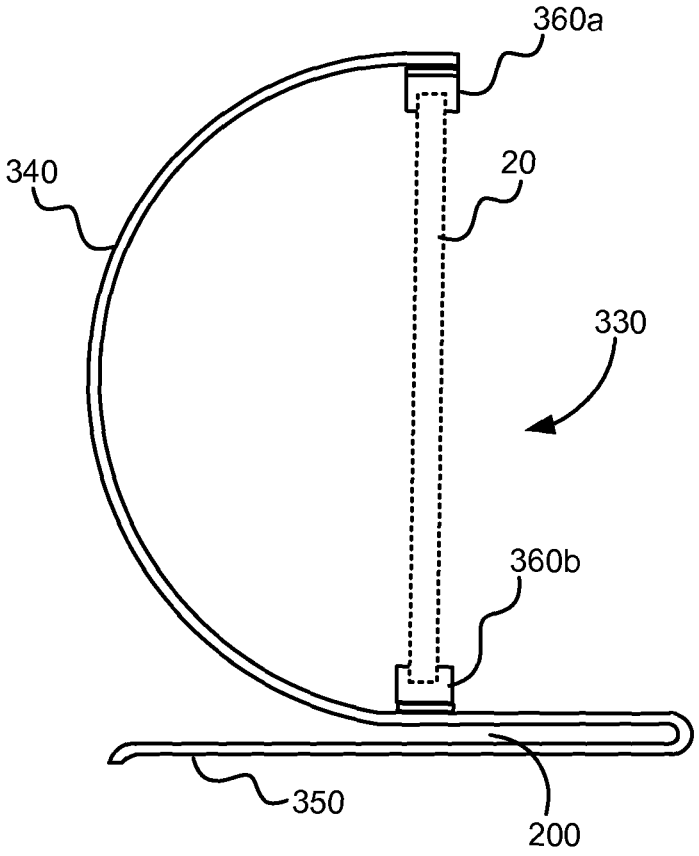
FIG. 21 is a side view in elevation of the pair of vertically spaced-apart brackets coupled to the C-shaped first end portion of the alternative configuration of the clip, the pair of brackets releasably securing the electronic device therebetween.
Figure 22:
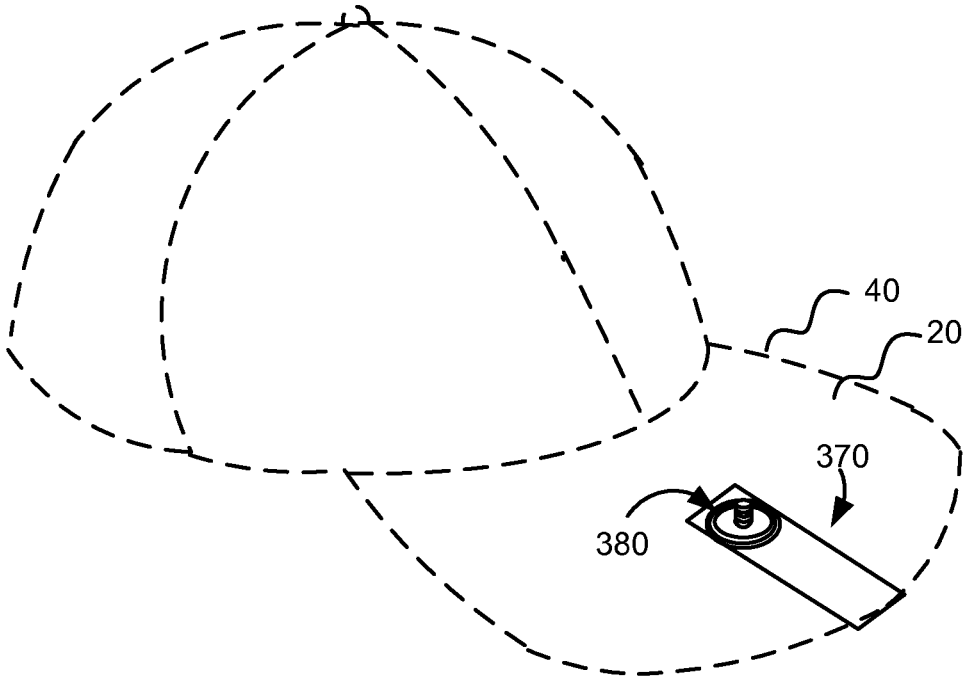
FIG. 22 is a view in perspective of another alternative configuration of the clip engaging the brim of the headpiece, the another alternative configuration of the clip including a mount for mounting the electronic device thereon.
Figure 23:
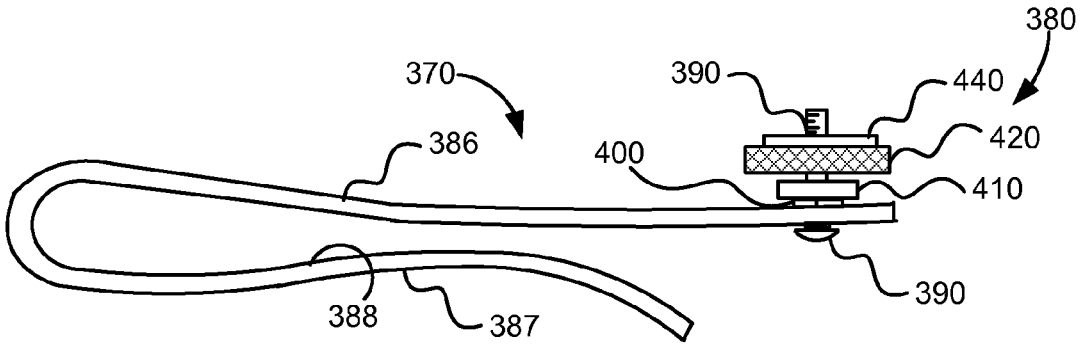
FIG. 23 is a side view in elevation of the another alternative configuration of the clip, the another alternative configuration of the clip including the mount for mounting the electronic device thereon.
Figure 24:
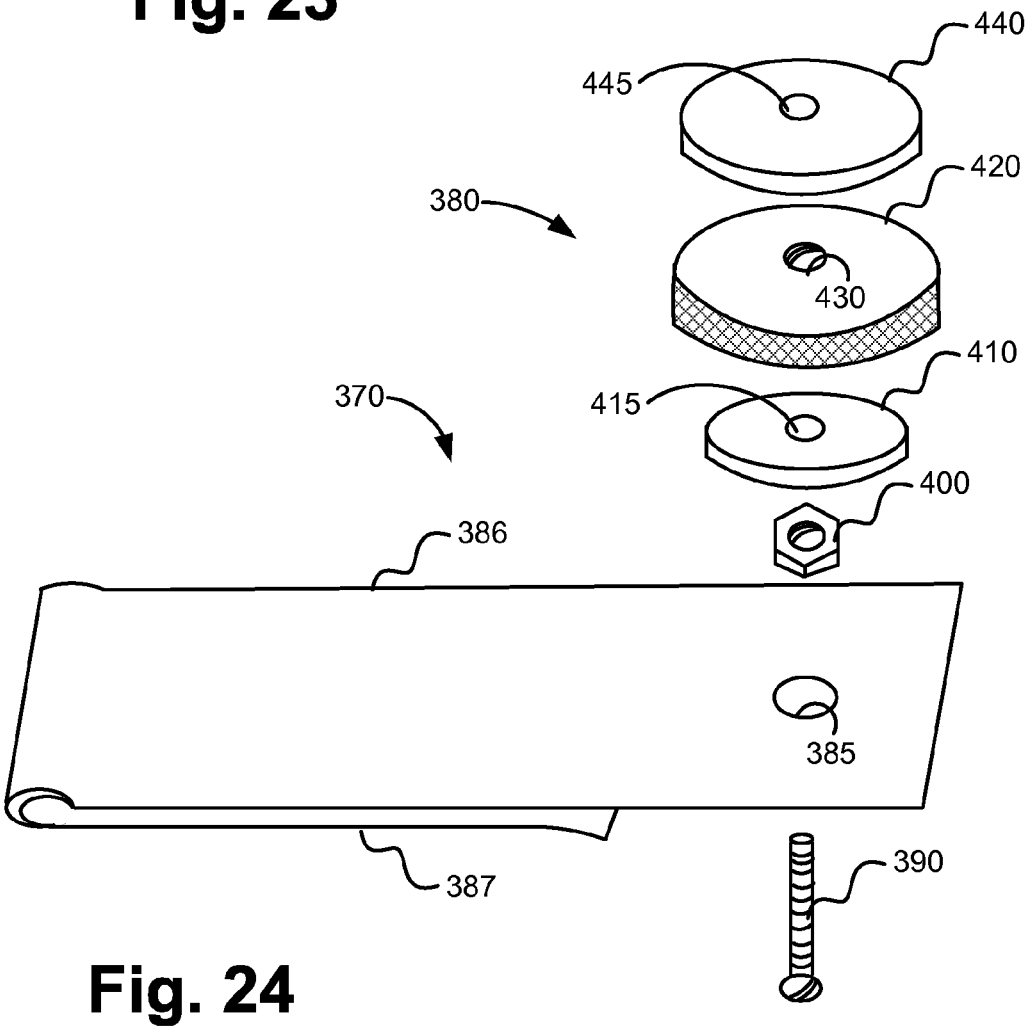
FIG. 24 is an exploded view of the another alternative configuration of the clip.

Therefore, as shown in FIGS. 15 and 16, each of clips 170 is pivotally coupled to bottom surface 250 of base 245 by means of a pivot pin 320. Pivot pin 320 is in turn affixed to bottom surface 250 of base 245 in order to anchor clips 170 to base 245. In this manner, each clip 170 can be manually pivoted about pivot pin 320 and extended outwardly to engage brim 30, so that base 245 and cradle 80 can be mounted on brim 30. In addition, each clip 170 can be manually pivoted about pivot pin 320 and retracted inwardly to conveniently stow the apparatus in pocket or purse after base 245 and cradle 80 are dismounted from brim 30.

With reference to FIGS. 17, 18, 19, 20 and 21, there is shown another configuration clip, generally referred to as 330, for mounting electronic device 20 on brim 30 of headpiece 40. There may be two clips 330. Each clip 330 has a flexible C-shaped first end portion 340 for retaining electronic device 20 and a U-shaped second end portion 350 for engaging brim 30 of headpiece 40. In addition, a plurality of brackets, such as brackets 360*a* and 360*b*, are coupled to C-shaped first end portion 340 for receiving electronic device 20, so that electronic device 20 is releasably captured by brackets 360*a*/360*b* in order to allow mounting of electronic device 20 on brim 30 of headpiece 40. Brackets 360*a*/360*b*, which are vertically aligned with each other, are separated by a predetermined distance "X1" for receiving electronic device 20 between brackets 360*a*/360*b*. In this regard, electronic device 20 has a width slightly greater than "X1." It should be appreciated that the convex curvature of C-shaped first end portion 340 has a predetermined spring constant that necessarily provides a spring-like clamping force at brackets 360*a*/360*b* in order to securely hold electronic device 20 between brackets 360*a*/360*b*. It should also be appreciated that flexibility of C-shaped first end portion 340 allows predetermined distance "X1" to be varied a limited extent in order to accept electronic devices of various widths "X2."

Referring to FIGS. 22, 23, 24 and 25, there is shown another configuration of the U-shaped clip, generally referred to as 370, for mounting electronic device 20 on brim 30 of headpiece 40. More specifically, a mount, generally referred to as 380, is coupled to dip 370 for mounting electronic device 20 on clip 370. In order to accommodate mount 380, clip 370 defines a hole 385 formed through an upper leg 386 of clip 370. An opposed lower leg 387 is integrally attached to upper leg 386, so as to define a space 388 sized to accept and intimately engage brim 30. Mount 380 includes an externally-threaded screw 390 insertable through hole 385, so as to threadably engage an internally-threaded nut 400, as shown. There may be a first washer 410 disposed in alignment with nut 400. First washer 410 defines a hole 415 that accepts screw 390 therethrough. Also, disposed in alignment with first washer 410 is an adjustment disk 420 having an internally-threaded bore 430 therethrough for threadably engaging externally-threaded screw 390. Disposed atop adjustment disk 420 may be a second washer 440 having a hole 445 that accepts screw 390 therethrough. Therefore, once fully inserted through hole 385, screw 390 will extend through and threadably engage nut 400, extend through first washer 410, extend through and threadably engage adjustment disk 420, and extend through second washer 440. A purpose of first washer 410 is to reduce friction between internally-threaded nut 400 and adjustment disk 420 to prevent nut 400 and disk 420 from sticking together as adjustment disk 420 is adjusted upwardly. A purpose of nut 400 is to lock screw 390 in-place, so that screw 390 does not become loose after screw 390 threadably engages nut 400. A purpose of second washer 440 is to provide a cushioning effect and reduce slippage between adjustment disk 420 and electronic device 20 in order to prevent undesired rotation of electronic device 20 from the desired position. Once mount 380 is assembled on the another configuration of clip 370, adjustment disk 420 can be manually rotated to be raised and lowered to tighten and loosen, respectively, a tripod head mounted mechanism or support structure, generally referred to as 450 (see FIG. 25), that is configured to support electronic device 20.

Support structure 450 threadably engages a top portion of screw 390. Support structure 450 allows manual rotation of support structure 450 due to the threaded engagement of support structure 450 with the top portion of screw 390. Adjustment disk 420 raises or lowers to tighten or loosen, respectfully, the upper surface against the lower surface of support structure 450 in order to adjust support structure 450 to a desired angular position. Thus, rotational adjustment of support structure 450 allows capture of images and sounds at a plurality of orientations associated with the spatial locations of objects and events to be recorded by electronic device 20. Capture of images and sounds can also be achieved by user 45 turning his head in the direction of the images and/or sounds. Support structure 450 is commercially available and forms no part of the present invention, except when made, used, offered for sale, sold, or imported in combination with clip 370.

Figure 26:
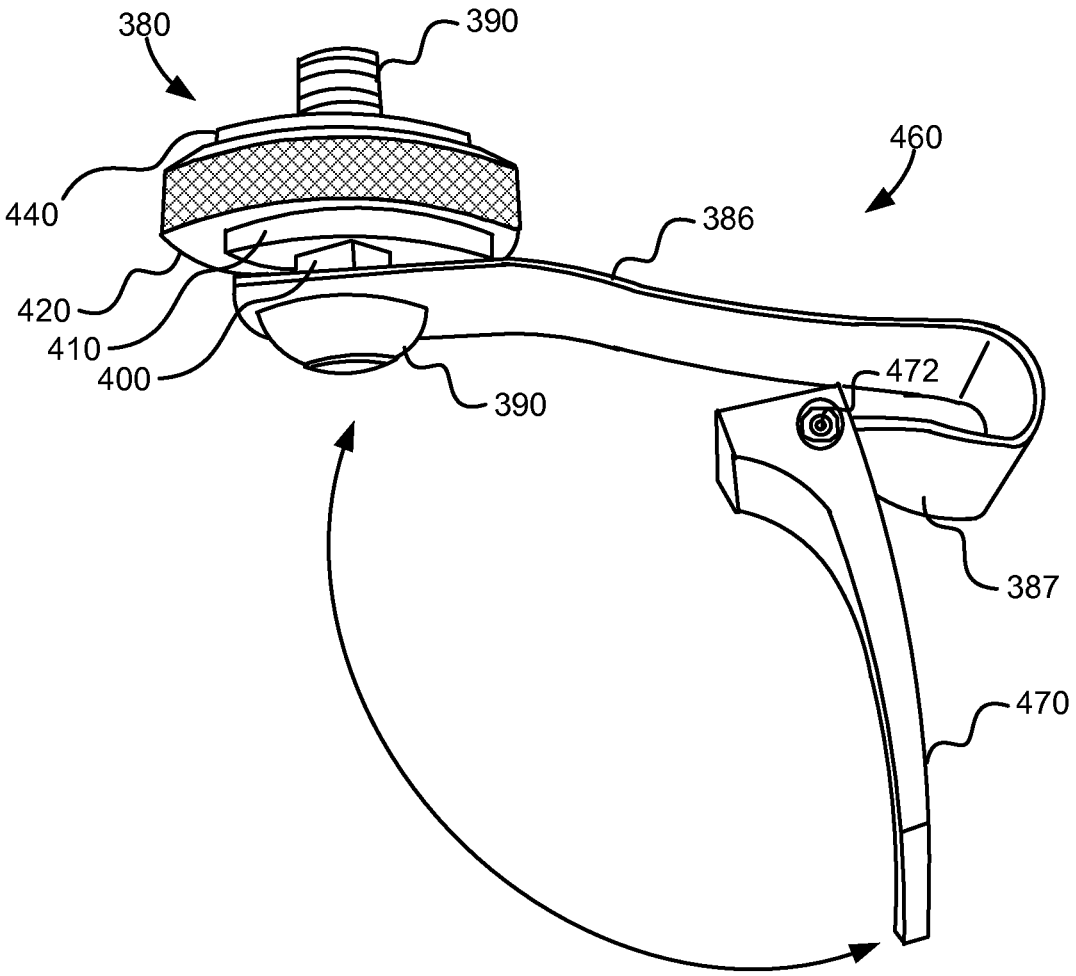
FIG. 26 is a bottom view in perspective of yet another alternative configuration of the clip including the mount and a locking arm, the locking arm being shown in a first position.
Figure 26A:
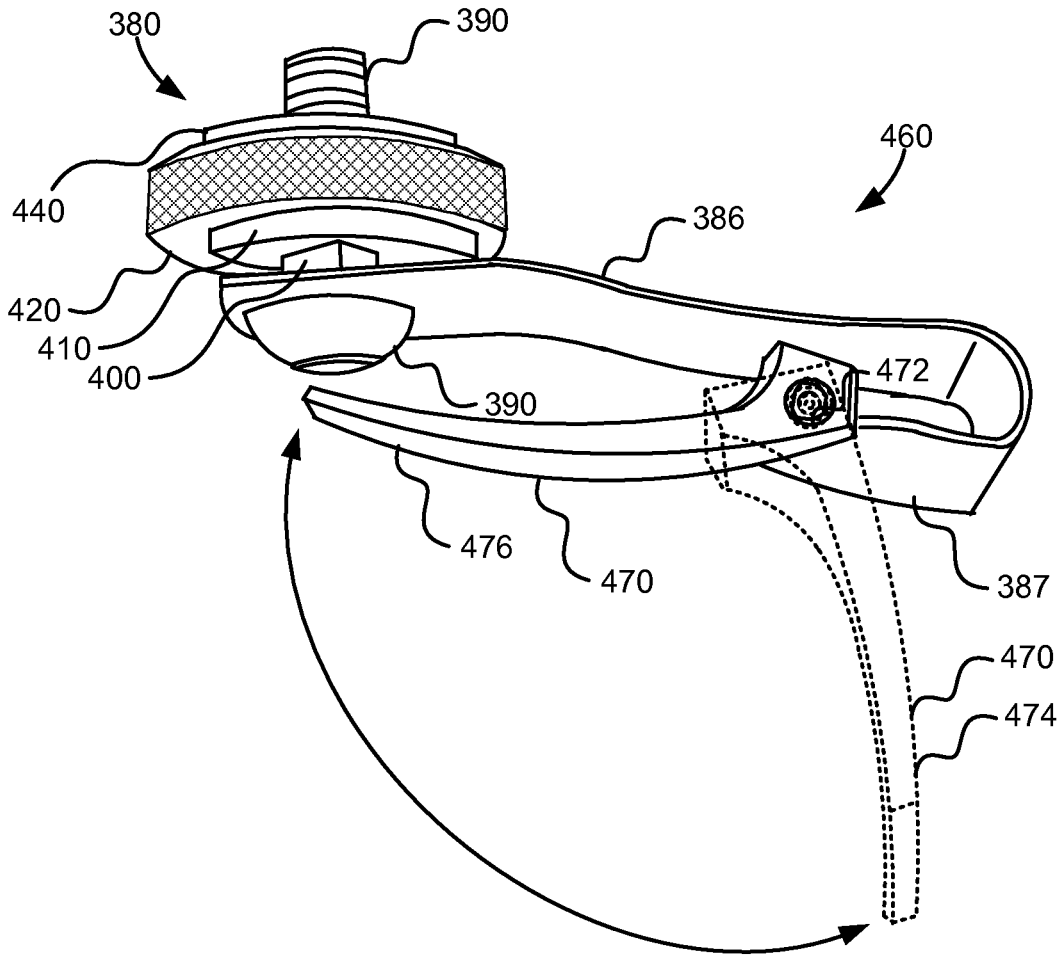
FIG. 26A is a view in perspective of the yet another alternative configuration of the clip including the mount and the locking arm, this view showing the locking arm pivotally moved from the first position to a second position.
Figure 27:
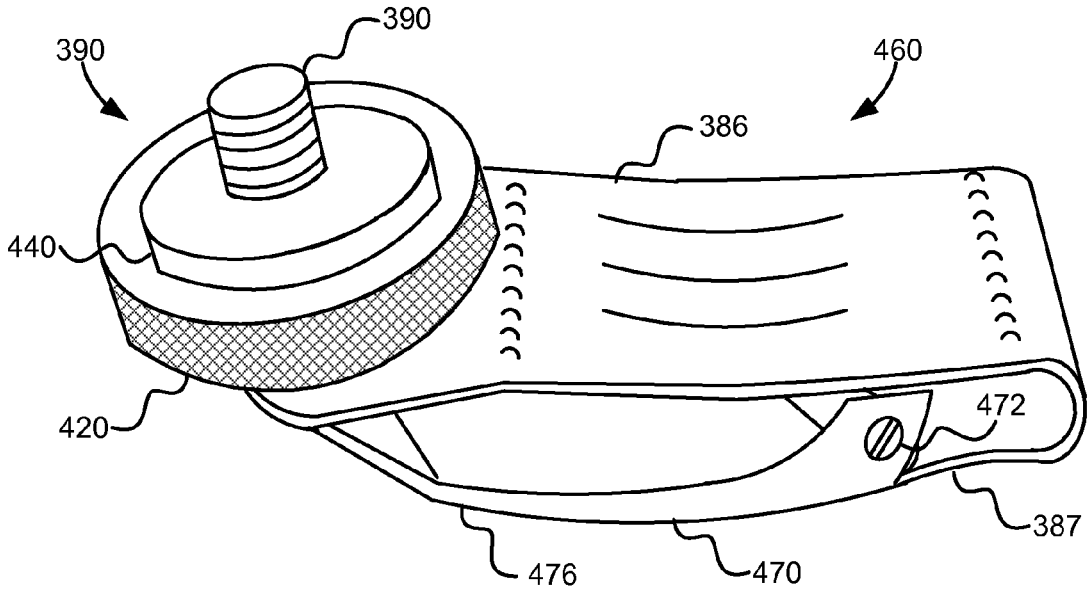
FIG. 27 is a view in perspective of the yet another alternative configuration of the clip including the mount and the locking arm, this view showing the locking arm in a fully locked position.

As shown in FIGS. 26, 26A and 27, another configuration of a clip, generally referred to as 460, is there shown. Clip 460 is similar to clip 370, except clip 460 comprises a movable, arcuate-shaped locking arm 470 for releasably locking clip 460 to brim 30 of headpiece 40 while clip 460 engages brim 30 of headpiece 40. Locking arm 470 is arcuate-shaped, so that locking arm 470 can be easily grasped by wearer 45. Locking arm 470 is pivotally coupled to second leg 387 at a pivot pin 472, such that locking arm 470 can be manually pivoted from a first position 474 to a second position 476. When locking arm 470 pivots to second position 476, locking arm 470 will intimately engage brim 30 of headpiece 40 and be held thereat by force of friction. Locking arm 470 is disengaged from brim 30 by manually overcoming the force of friction. In this regard, locking arm 470 is disengaged from brim 30 by manually pivoting locking arm 470 from second position 476 to first position 474. In this manner, clip 460 is removeably mounted on brim 30 of headpiece 40.

Figure 28:
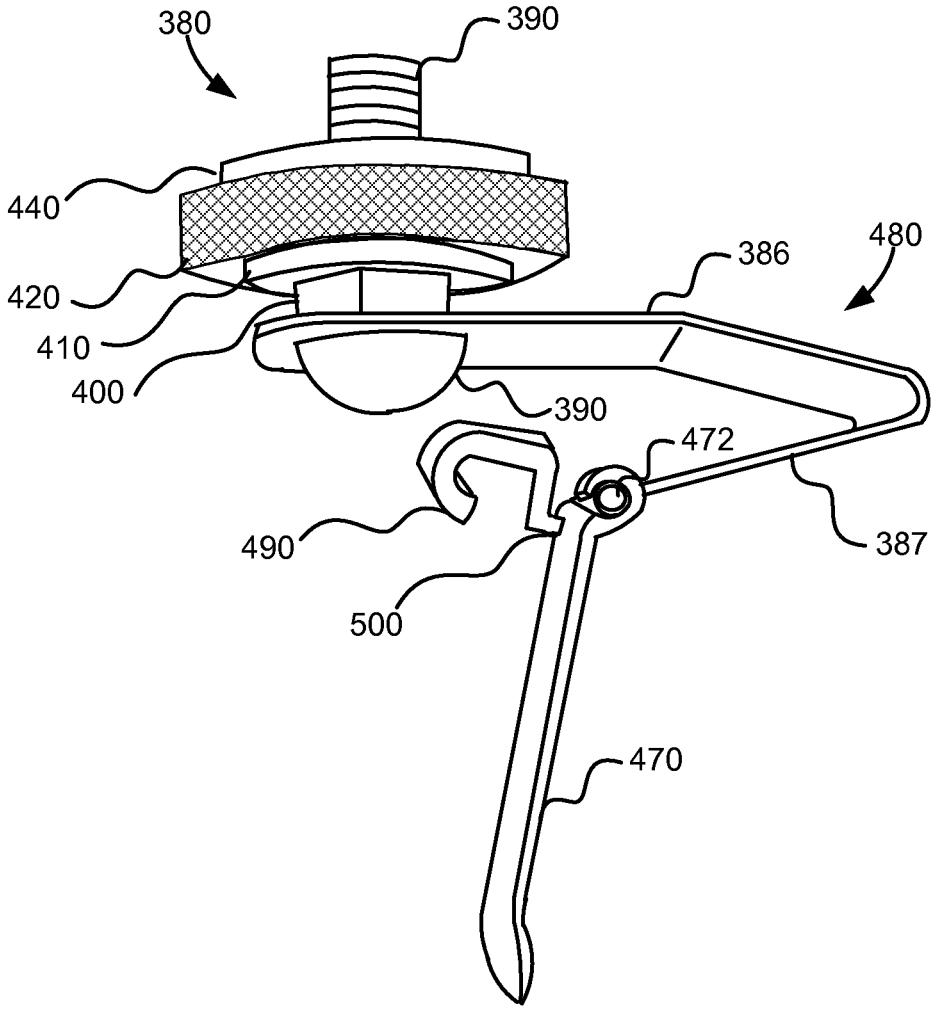
FIG. 28 is a view in perspective of still another alternative configuration of the clip including the mount and the locking arm, this view showing a hook coupled to the locking arm for engaging the brim of the headpiece.

As best seen in FIG. 28, another configuration of the clip, generally referred to as 480, includes previously mentioned locking arm 470, except a hook member 490 is coupled to an upper end portion of locking arm 470, as at location 500. A purpose of hook member 490 is to intimately engage brim 30 when locking arm 470 pivots to second position 476 (see FIG. 27).

Figure 29:
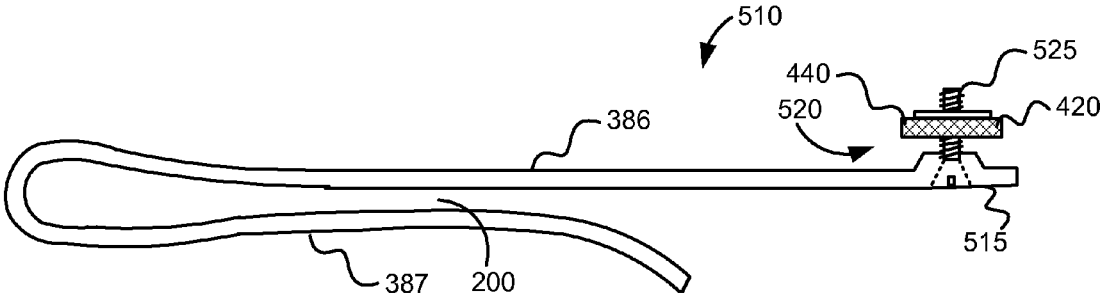
FIG. 29 is a view in elevation of an additional alternative configuration of the clip including the mount, the mount being immovable.
Figure 30:
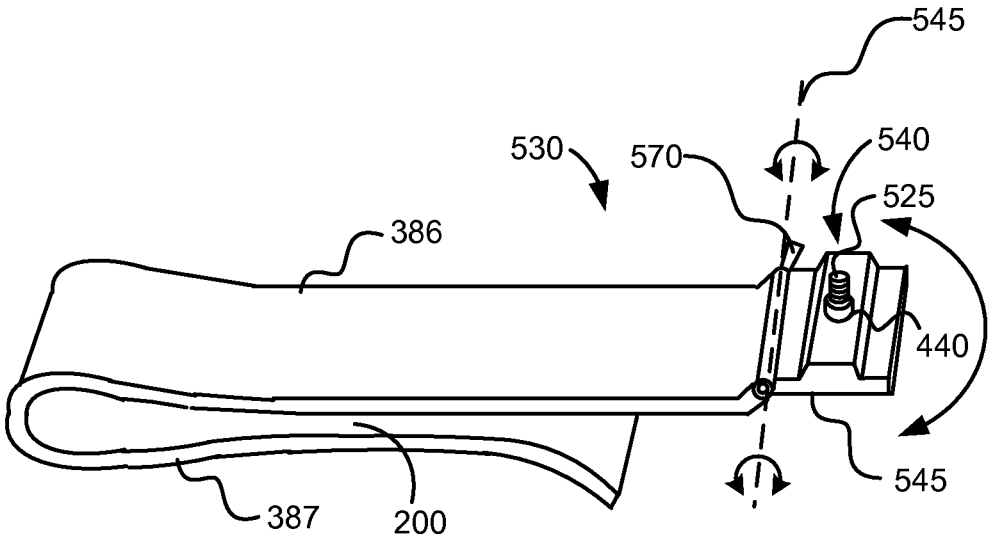
FIG. 30 is a view in elevation of the additional alternative configuration of the clip including the mount, the mount being rotatable about a horizontal axis.
Figure 30A:
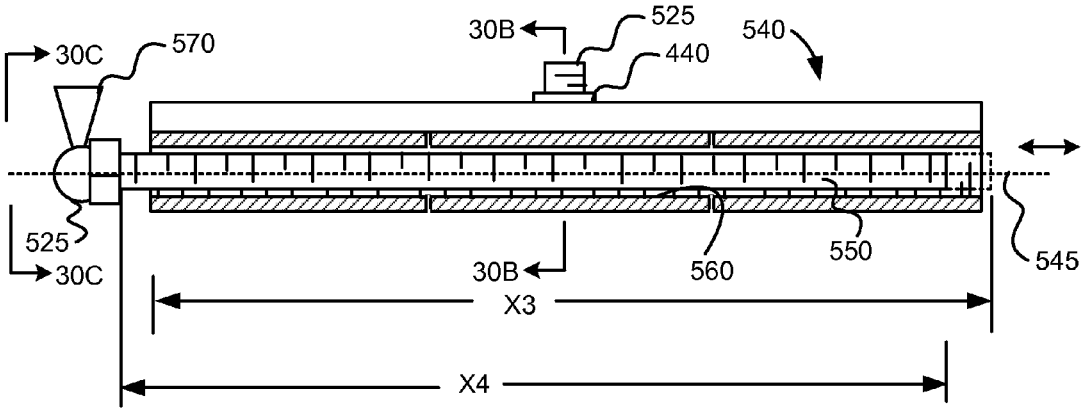
FIG. 30A is a view in partial elevation of the additional alternative configuration of the clip including the mount, the mount being rotatable about the horizontal axis by means of a threaded shaft coupled to the mount.
Figure 30B:
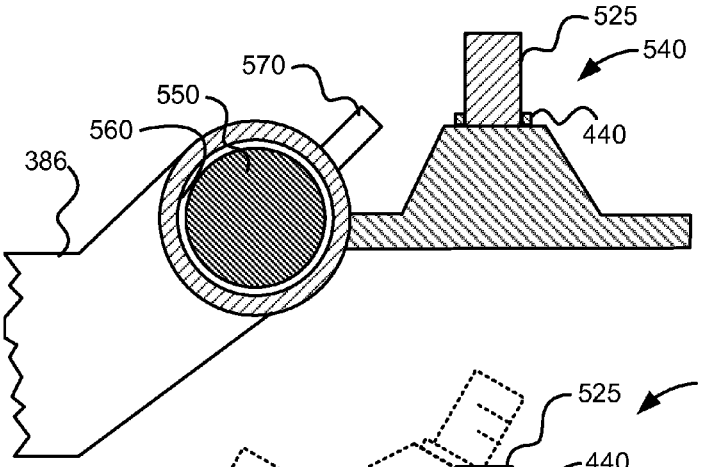
FIG. 30B is a view taken along section line 30B-30B of FIG. 30A.
Figure 30C:
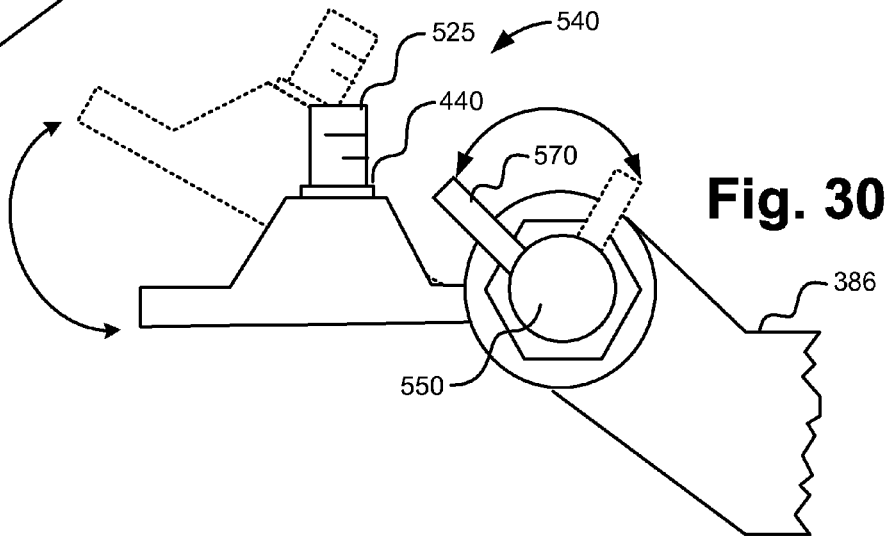
FIG. 30C is a view taken along section line 30C-30C of FIG. 30A.
Figure 31:
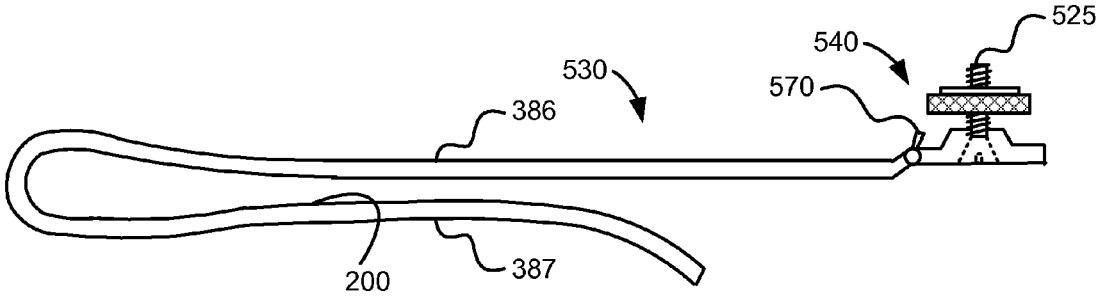
FIG. 31 is a view in elevation of the additional alternative configuration of the clip including the mount, the mount being shown in a default position.
Figure 31A:
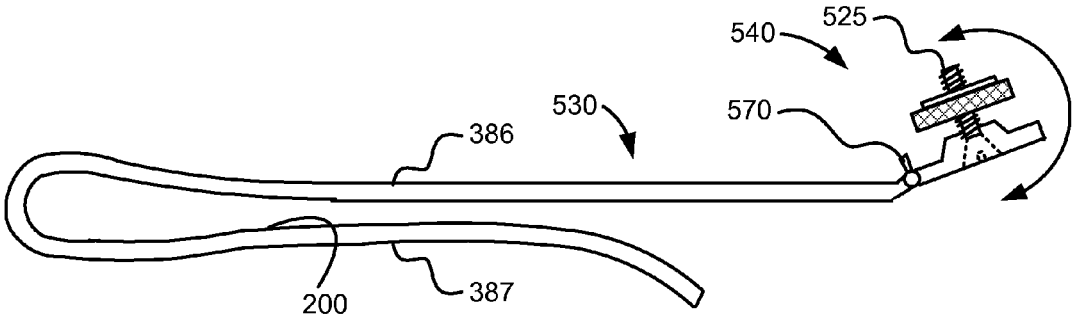
FIG. 31A is a view in elevation of the additional alternative configuration of the clip including the mount, the mount being rotated upwardly by means of the threaded shaft coupled to the mount.

With reference to FIG. 29, yet another configuration of the clip, generally referred to as 510, includes an internally threaded end portion 515 that belongs to first leg 386. A mount, generally referred to as 520, supports previously mentioned adjustment disk 420, such that adjustment disk 420 is movable upwardly and downwardly by rotating adjustment disk 420 on screw 525 either clockwise or counter-clockwise, respectively.

With reference to FIGS. 30, 30A, 30B, 30C, 31, 31A, 32 and 32A still another configuration clip, generally referred to as 530, includes a mount 540 pivotally connected to first leg 386 so as to be pivoted about a horizontal pivot axis 545 oriented perpendicularly with respect to a side edge of first leg 386, as described in detail hereinafter. Electronic device 20 is coupled to mount 540. Therefore, inclination of mount 540 relative to first leg 386 varies as mount 540 is pivoted. In this regard, inclination of electronic device 20 varies as inclination of mount 540 varies in order to appropriately capture an image located at or sound emanating from a position located at an upward or downward angle relative to clip 530. To achieve this result, mount 540 is rotatable about horizontal axis 545 by means of an externally threaded elongate shaft 550 (see FIG. 30A). The shaft 550 is threadably received in an internally threaded bore 560 defined by mount 540. Shaft 550 includes a lever 570 integrally connected to a terminal end thereof for rotating shaft 550, so that shaft 550 threadably translates between a first position "X3" and a second position "X4." It should be appreciated that, as shaft 550 translates between first position "X3" and second position "X4", mount 540 will pivot about axis 545 and incline upwardly or downwardly, respectively.

Figure 32:
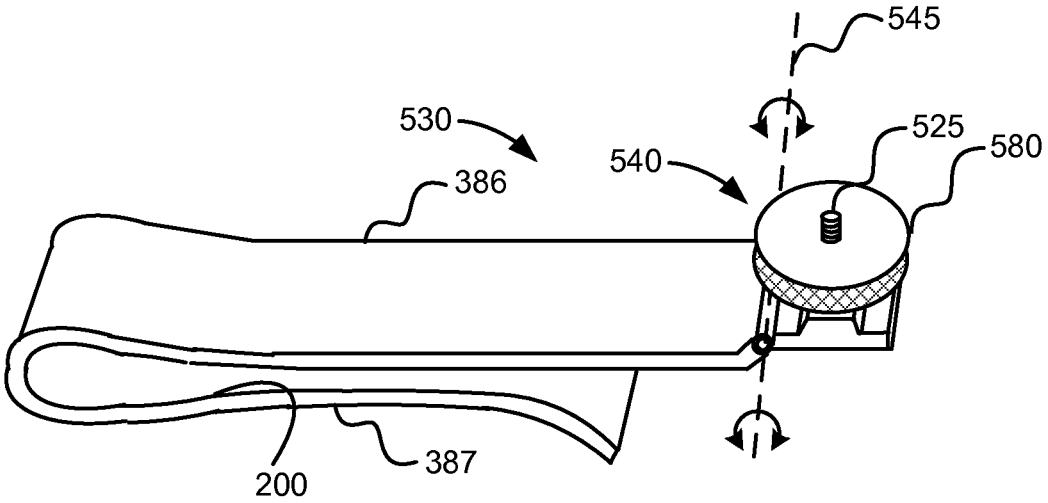
FIG. 32 is a view in perspective of the additional alternative configuration of the clip including the mount being shown in a default position.
Figure 32A:
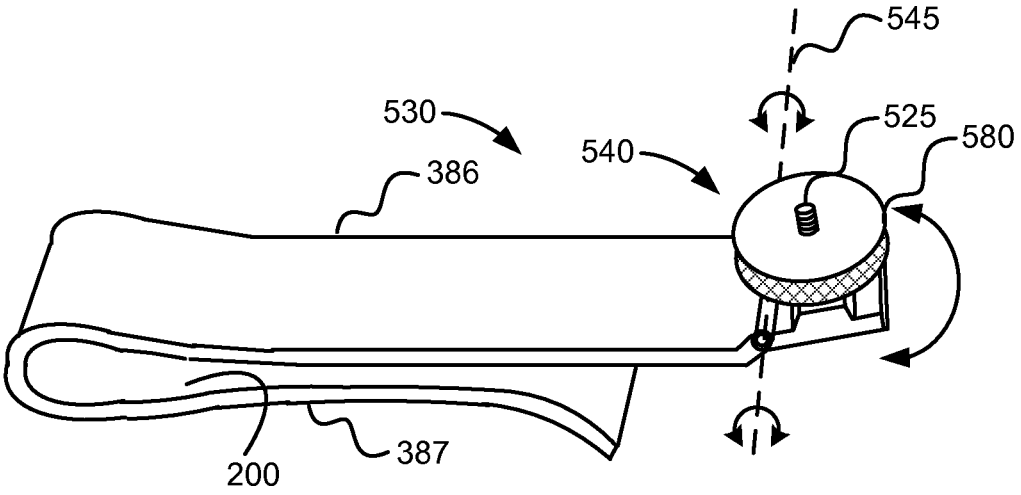
FIG. 32A is a view in perspective of the additional alternative configuration of the clip including the mount, the mount being shown rotated upwardly by means of the threaded shaft coupled to the mount.

In FIGS. 32 and 32A, mount 540 is shown connected to clip 530. In this regard, mount 540 is shown in a default position (see FIG. 32) and in an inclined position (see FIG. 32A). Adjustment disk 420 threadably engages screw 525, and is manually raised or lowered to tighten the upper surface of adjustment disk 420 against the lower surface of electronic device 20 or lower surface of previously mentioned support structure 450 (see FIG. 25) to lock support structure 450, and hence electronic device 20, in the desired orientation.

Figure 33:
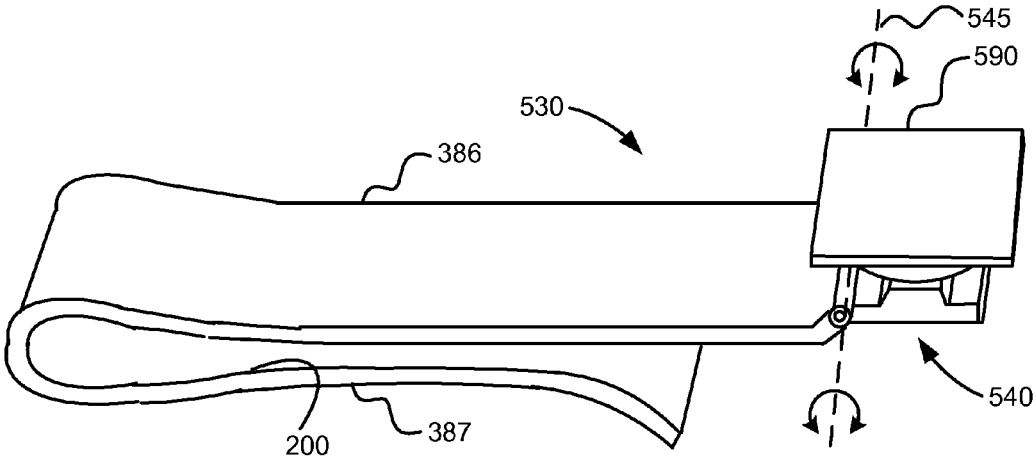
FIG. 33 is a view in perspective of the additional alternative configuration of the clip including the mount shown in a default position, the mount including a parallelepiped-shaped plate for mounting thereon a device mount (not shown) affixed to an upper flat surface of the plate by means of adhesive, glue, 2-sided tape or other means, for electronic devices that do not directly affix to a tripod mount (not shown), to which tripod mount an electronic device may be mounted.
Figure 34:
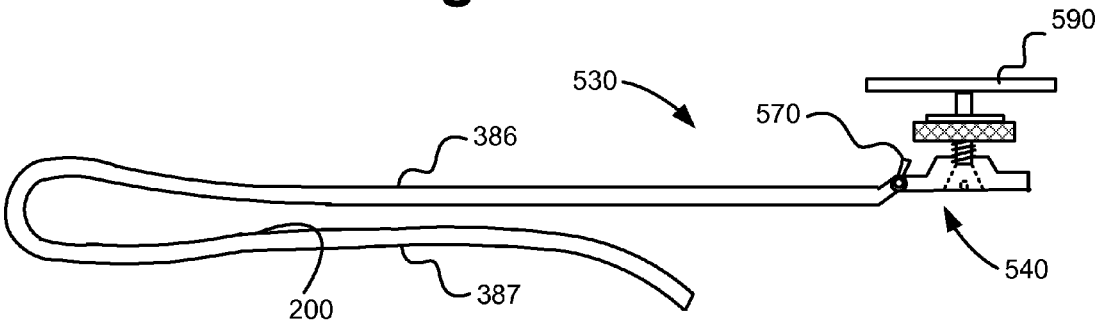
FIG. 34 is a view in elevation of the additional alternative configuration of the clip including the mount being shown in a default position, the mount including the parallelepiped-shaped plate, as shown in FIG. 33 hereinabove, for mounting the device mount.
Figure 34A:
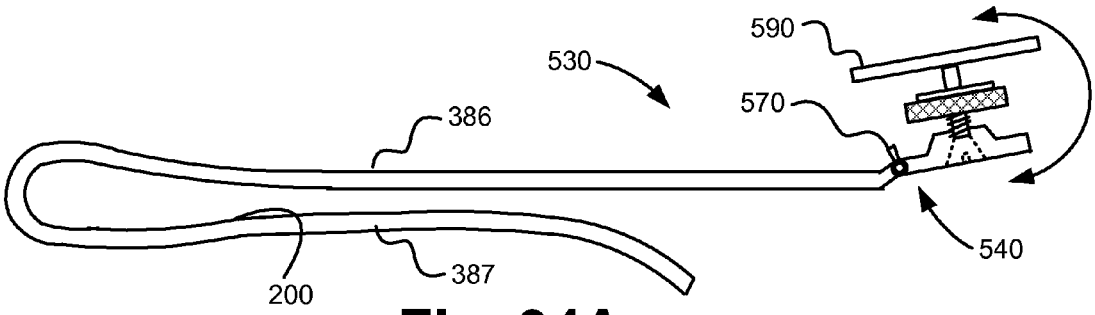
FIG. 34A is a view in elevation of the additional alternative configuration of the clip including the mount, the mount being shown rotated upwardly by means of the threaded shaft coupled to the mount, the mount including the parallelepiped-shaped plate for mounting the device mount, as indicated in FIGS. 33 and 34 hereinabove.

In FIGS. 33, 34 and 34A, mount 540 is shown connected to clip 530. Mount 540 is shown in a default position (see FIGS. 33 and 34) and in an inclined position (see FIG. 34A). In both the default position and the inclined position, a parallelepiped-shaped plate 590 is connected to mount 540 for supporting electronic device 20. A purpose of parallelepiped-shaped plate 590 is to allow mounting a device mount (not shown) thereon. Such a device mount is affixed to an upper flat surface of plate 590 by means of adhesive, glue, 2-sided tape or other means, in order to accommodate electronic devices that do not directly affix to a tripod mount (not shown) to which electronic device 20 can be mounted.

Figure 35:
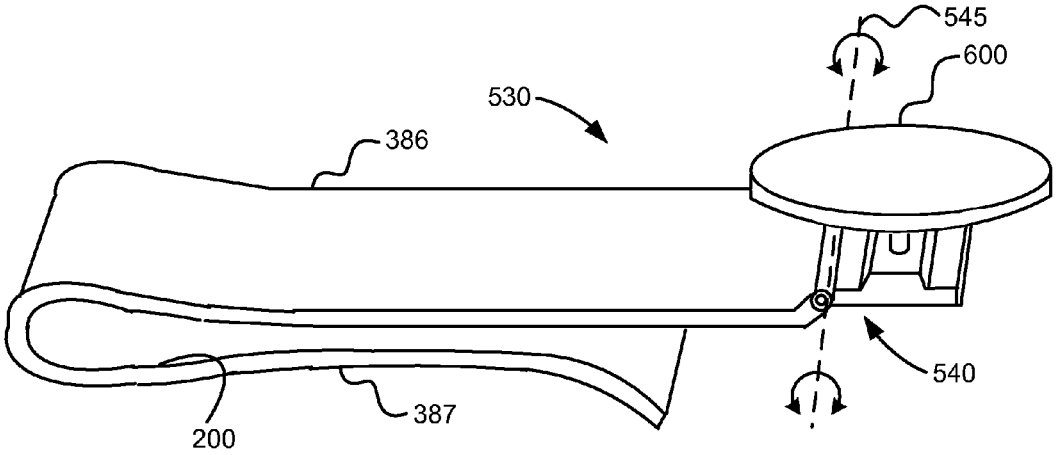
FIG. 35 is a view in perspective of the additional alternative configuration of the clip including the mount, the mount including a circularly-shaped plate of wide diameter for mounting the device mount in order to accommodate a larger electronic device, as indicated in FIGS. 33, 34 and 34A hereinabove.
Figure 36:
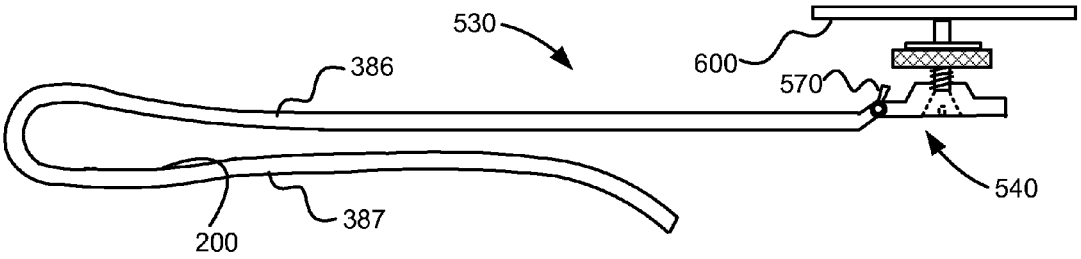
FIG. 36 is a view in elevation of the additional alternative configuration of the clip including the mount shown in a default position, the mount including the circularly-shaped plate of wide diameter for mounting the device mount as indicated in FIG. 35 hereinabove.
Figure 36A:
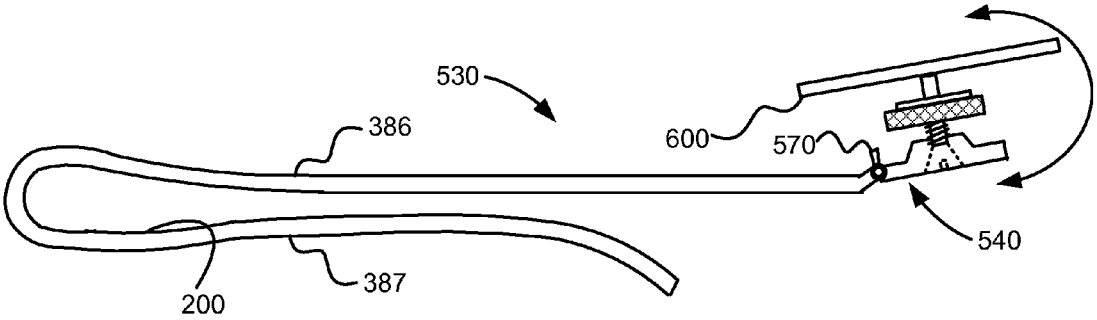
FIG. 36A is a view in elevation of the additional alternative configuration of the clip including the mount, the mount being shown rotated upwardly by means of the threaded shaft coupled to the mount, the mount including the circularly-shaped plate of wide diameter for mounting the device mount, as indicated in FIG. 35 hereinabove.

In FIGS. 35, 36 and 36A, mount 540 is shown connected to clip 530. Mount 540 is shown in a default position (see FIGS. 35 and 36) and in an inclined position (see FIG. 36A). In both the default position and the inclined position, a circularly-shaped plate 600 of wide diameter is connected to mount 540 for supporting electronic device 20. A purpose of circularly-shaped plate 600 is to allow mounting the device mount (not shown) thereon. Such a device mount is affixed to an upper flat surface of plate 600 by means of adhesive, glue, 2-sided tape or other means, in order to accommodate electronic devices that do not directly affix to a tripod mount (not shown) to which electronic device 20 can be mounted.

Figure 36B:
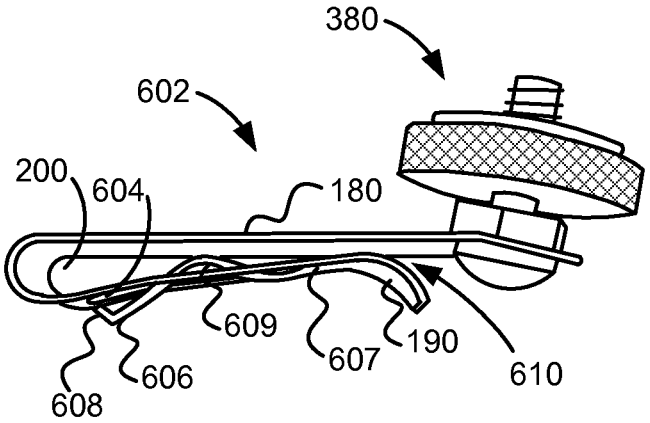
FIG. 36B is a view in perspective of yet another alternative configuration of the clip including the mount, the clip having a leaf spring in operative condition to engage the brim of the headpiece and the mount being shown in operative condition to accommodate support structure that holds the electronic device.
Figure 36C:
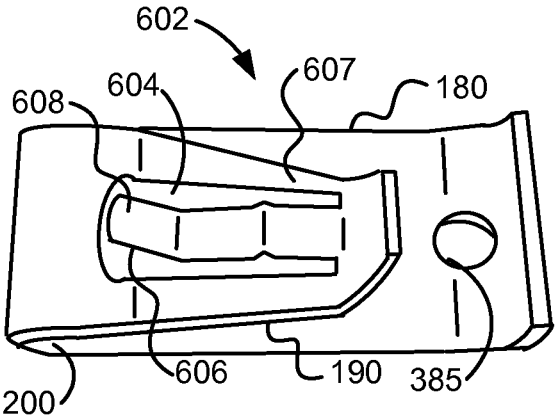
FIG. 36C is a bottom view in perspective of the yet another alternative configuration of the clip including the leaf spring.
Figure 36D:
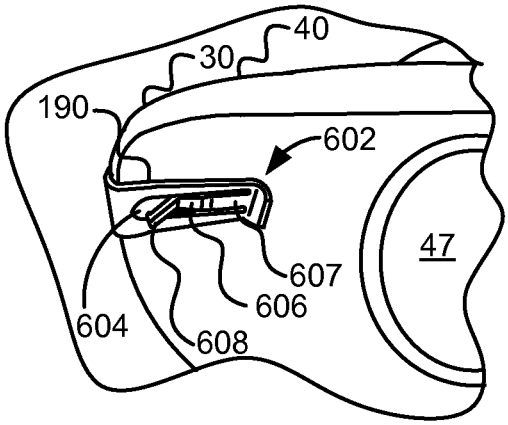
FIG. 36D is a fragmentary, bottom view in perspective of the yet another alternative configuration of the clip and leaf spring engaging the brim of the headpiece.

With reference to FIGS. 36B, 36C and 36D, yet another alternative configuration of the clip, generally referred to as 602, is there shown. Clip 602 is similar to clip 170, except second leg 190 (see FIG. 8) includes an elongate aperture 604 sized to receive a flexible leaf spring 606. Leaf spring 606 is integrally formed with second leg 190 at one end portion 607 of leaf spring 606 and has an opposite end portion 608 that is a free end portion of leaf spring 606. Leaf spring 606 also has a raised ridge 609 that securely, but removably, engages brim 30 of headpiece 40 as brim 30 is received in gap 200. Clip 602 remains removably engaged with brim 30 substantially due to force of friction between ridge 609 and brim 30. Clip 602 also engages brim 30, as at a point 610, where brim 30 first engages clip 602 between first leg 180 and second leg 190 and is removably held thereat by force of friction. Clip 620 can be disengaged from brim 30 by manually pulling clip 620 in a manner that overcomes the force of friction imposed by ridge 609 and legs 180/190. Mount 380 for electronic device 20 is secured in hole 385 in the manner previously described. It will be appreciated momentarily that manipulation of end portion 608 can be used to engage clip 620 with brim 30. In this regard, manual pressure can be upwardly applied to end portion 608 by user 45. As manual pressure is upwardly applied to end portion 608, leaf spring 606 will bend or deform such that gap 200 widens where ridge 609 resides.

Brim 30 can then be inserted into the widened gap 200. Manual release of end portion 608 removes the pressure that is upwardly applied to end portion 608. The flexible characteristic of leaf spring 606 then allows ridge 609 to engage brim 30.

Illustrative Method:

An illustrative method associated with an exemplary embodiment for manufacturing the apparatus for mounting an electronic device on a brim of a headpiece will now be described.

Figure 37:
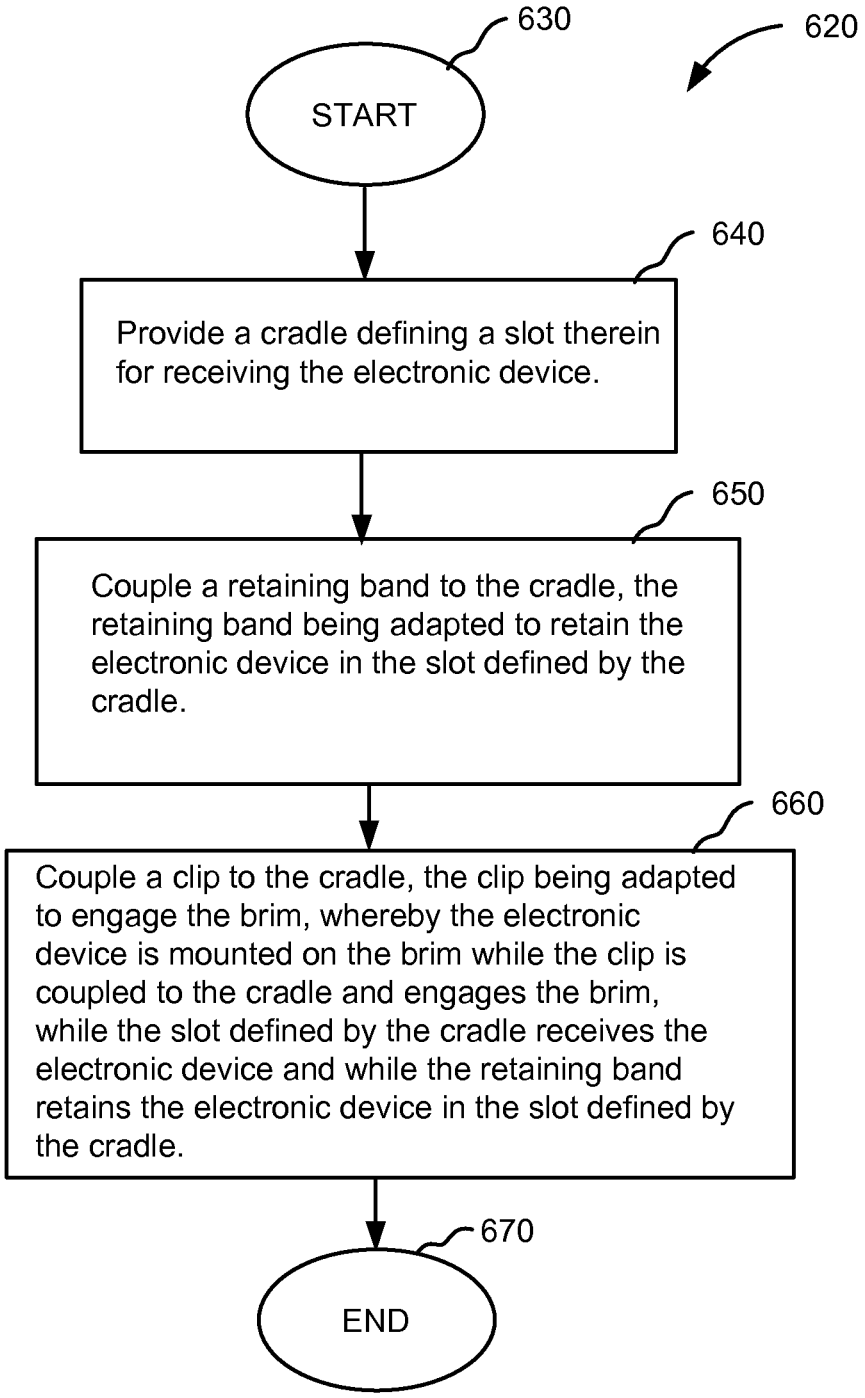
FIG. 37 is a flowchart showing an illustrative method of manufacturing an apparatus for mounting an electronic device on a brim of a headpiece.

Referring to FIG. 37, an illustrative method, generally referred to as 620, is provided for manufacturing an apparatus for mounting an electronic device on a brim of a headpiece. The method starts at a step 630. At a step 640, a cradle defining a slot therein for receiving the electronic device is provided. At a step 650, a retaining band is coupled to the cradle, the retaining band being adapted to retain the electronic device received into the slot defined by the cradle. At a step 660, a clip is coupled to the cradle, the clip being adapted to engage the brim, whereby the electronic device is mounted on the brim while the clip is coupled to the cradle and engages the brim, while the slot defined by the cradle receives the electronic device and while the retaining band retains the electronic device in the slot defined by the cradle. The method stops at a step 660.

Other modifications and implementations will occur to those skilled in the art without departing from the spirit and the scope of the invention as claimed. For example, plates 580/590/600 (see FIGS. 33, 34, 34A, 35, 36 and 36A) need not have the geometries described. Rather, plates 590/600 may have any suitable geometry, such as an octagon shape, that is convenient for manufacture thereof. As another example, although various embodiments of the invention are described as having an electronic device coupled thereto, other devices may be coupled to the apparatus, as well, such as flashlights, advertising and marketing signs and devices, mechanical (i.e., non-electronic) cameras, medical devices, costume embellishments, and the like. Accordingly, the description hereinabove is not intended to limit the invention, except as indicated in the following claims.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. The patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicant(s).

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Therefore, provided herein are an apparatus for mounting an electronic device on a brim of a headpiece and method of manufacturing the apparatus.

What is claimed is:

1. An apparatus for mounting an electronic device on a brim of a headpiece, comprising:

(a) a clip having an upper leg and a lower leg said clip adapted to support the electronic device, wherein said lower leg having a flexible leaf spring and a ridge thereon for engaging the brim, wherein said upper leg having an aperture through which a threaded shaft is affixed, said threaded shaft extending upward away from said brim of said headpiece and able to receive an electronic device; and (b) an adjustment disk able to be received by said threaded shaft for locking said electronic device to said apparatus for mounting said electronic device on the brim of said headpiece.

2. The apparatus of claim 1, wherein said upper leg further comprises a mount, wherein said mount is an attachable platform adapted to support the electronic device and is affixed to said threaded shaft.

3. The apparatus according to claim 1, wherein said aperture is an internally threaded bore able to receive said threaded shaft.

4. The apparatus according to claim 1, wherein a portion of said upper leg containing said aperture is angled.

5. The apparatus according to claim 1, wherein said upper leg further comprises a hinge and a first leg, wherein said first leg contains said aperture through which the threaded shaft is affixed and is pivotable about a horizontal axis oriented perpendicular to a side edge of said first leg.

* * * * *